US010115358B2

(12) United States Patent
Lee et al.

(10) Patent No.: US 10,115,358 B2
(45) Date of Patent: Oct. 30, 2018

(54) DISPLAY APPARATUS

(71) Applicant: SAMSUNG DISPLAY CO., LTD., Yongin, Gyeonggi-Do (KR)

(72) Inventors: Junpyo Lee, Asan-si (KR); Joo Hong Seo, Hwaseong-si (KR); ByungKil Jeon, Hwaseong-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 108 days.

(21) Appl. No.: 14/745,811

(22) Filed: Jun. 22, 2015

(65) Prior Publication Data

US 2016/0035292 A1 Feb. 4, 2016

(30) Foreign Application Priority Data

Jul. 31, 2014 (KR) ..... 10-2014-0098024

(51) Int. Cl.
*G09G 5/02* (2006.01)
*G09G 3/36* (2006.01)

(52) U.S. Cl.
CPC ... *G09G 3/3648* (2013.01); *G09G 2300/0443* (2013.01); *G09G 2300/0452* (2013.01); *G09G 2320/0673* (2013.01); *G09G 2340/06* (2013.01)

(58) Field of Classification Search
CPC ..... G09G 3/3607; G09G 3/3648; G09G 2300/0443; G09G 2300/0452; G09G 2310/0218; G09G 2320/0673; G09G 2340/06
USPC ..... 345/82, 87, 103, 690–695; 349/56, 141, 349/109
See application file for complete search history.

(56) References Cited

U.S. PATENT DOCUMENTS 6,664,973 B1 * 12/2003 Iwamoto ..... G06T 5/009 345/589
6,686,953 B1 * 2/2004 Holmes ..... H04N 1/6033 348/179
7,710,388 B2 5/2010 Hirata et al.
8,350,993 B2 1/2013 Miyashita
8,525,762 B2 * 9/2013 Lin ..... G09G 3/3225 345/82
9,735,207 B2 * 8/2017 Chen ..... H01L 27/3218
2002/0024618 A1 * 2/2002 Imai ..... H04N 9/3114 348/743
2006/0262053 A1 * 11/2006 Lee ..... G09G 3/3225 345/76
2006/0290831 A1 * 12/2006 You ..... G02F 1/133514 349/56
2007/0008461 A1 * 1/2007 Kobayashi ..... G02F 1/133514 349/106
2007/0279364 A1 * 12/2007 Moh ..... G09G 3/3688 345/100

(Continued)

FOREIGN PATENT DOCUMENTS

KR 10-2009-0073903 A 7/2009
KR 10-2009-0131039 A 12/2009
KR 10-2015-0015681 A 2/2015

*Primary Examiner* — Prabodh M Dharia
(74) *Attorney, Agent, or Firm* — Lee & Morse, P.C.

(57) ABSTRACT

A display apparatus includes a plurality of primary color pixels and a plurality of white pixels. The white pixels include a first white pixel to receive a first white pixel signal generated based on a first gamma curve and a second white pixel to receive a second white pixel signal generated based on a second gamma curve.

28 Claims, 22 Drawing Sheets

(56) References Cited

U.S. PATENT DOCUMENTS

2008/0030660 A1* 2/2008 Roth ..... G09G 3/3607 349/106
2008/0068310 A1* 3/2008 Choi ..... G09G 3/3233 345/82
2008/0117142 A1* 5/2008 Lin ..... G09G 3/3225 345/76
2009/0102352 A1* 4/2009 Cok ..... H05B 33/22 313/498
2009/0122074 A1* 5/2009 Sung ..... G09G 3/2007 345/600
2009/0213048 A1* 8/2009 Park ..... G09G 3/2003 345/77
2010/0053043 A1* 3/2010 Sakamoto ..... H01L 27/3213 345/77
2010/0066965 A1* 3/2010 Chen ..... G02F 1/134309 349/141
2010/0321415 A1* 12/2010 Cho ..... G09G 3/2014 345/690
2011/0063330 A1* 3/2011 Bae ..... G09G 3/3413 345/690
2012/0139965 A1* 6/2012 Yang ..... G09G 3/3225 345/690
2012/0249508 A1* 10/2012 Hsu ..... G09G 3/344 345/211
2012/0249924 A1* 10/2012 Li ..... G02F 1/133504 349/62
2012/0249934 A1* 10/2012 Li ..... G02F 1/133504 349/96
2012/0327137 A1 12/2012 Saitoh
2013/0010239 A1* 1/2013 Park ..... G02F 1/1309 349/106
2013/0021390 A1* 1/2013 Inada ..... G09G 3/2022 345/690
2013/0050282 A1* 2/2013 Kim ..... G09G 3/3413 345/690
2013/0063334 A1* 3/2013 Gibson ..... G02F 1/133553 345/107
2013/0070002 A1* 3/2013 Hisada ..... F21V 9/08 345/690
2013/0088534 A1* 4/2013 Arai ..... G09G 3/2003 345/691
2013/0135297 A1* 5/2013 Kobayashi ..... G06T 15/00 345/419
2013/0194170 A1* 8/2013 Saitoh ..... G09G 3/20 345/103
2014/0145586 A1* 5/2014 Choi ..... G09G 3/3208 313/504
2014/0184654 A1* 7/2014 Lee ..... G09G 3/3233 345/690
2014/0347609 A1* 11/2014 Li ..... G02F 1/133504 349/99
2015/0090985 A1* 4/2015 Park ..... H01L 27/3246 257/40
2015/0116375 A1* 4/2015 Yang ..... G09G 3/2003 345/690
2015/0235614 A1* 8/2015 Kim ..... G09G 5/02 345/205
2015/0318447 A1* 11/2015 Choi ..... H01L 27/322 257/98
2015/0356900 A1* 12/2015 Yang ..... G09G 3/20 345/88
2016/0012784 A1* 1/2016 Xu ..... G09G 3/3607 345/88

* cited by examiner

DISPLAY APPARATUS

CROSS-REFERENCE TO RELATED APPLICATION

Korean Patent Application No. 10-2014-0098024, filed on Jul. 31, 2014, and entitled: "Display Apparatus," is incorporated by reference herein in its entirety.

BACKGROUND

1. Field

One or more embodiments described herein relate to a display apparatus.

2. Description of the Related Art

A liquid crystal display includes a liquid crystal layer between upper and lower substrates having transparent electrodes. The display may also include upper and lower polarizing plates on outer surfaces of the upper and lower substrates, respectively. In operation, the arrangement of liquid crystal molecules in the liquid crystal layer is controlled to control transmittance of light passing through the liquid crystal layer. As a result, light is produced to form a desired image.

In one type of liquid crystal display, red, green, and blue pixels are disposed on a liquid crystal display panel for displaying color images. Another type of display may include white pixels.

SUMMARY

In accordance with one or more embodiments, a display apparatus includes a plurality of primary color pixels; and a plurality of white pixels including a first white pixel to receive a first white pixel signal generated based on a first gamma curve and a second white pixel to receive a second white pixel signal generated based on a second gamma curve. The first and second gamma curves may have different brightness values with respect to a same gray-scale.

The primary color pixels and the white pixels may form a plurality of pixel groups, the pixel groups may include a first pixel group to include the first white pixel and a second pixel group to include the second white pixel, and the first and second pixel groups are adjacent to each other. The primary color pixels may include red, green, and blue pixels to respectively display red, green, and blue colors, and each of the first and second pixel groups may include the red, green, and blue pixels.

First and second pixels among the primary color pixels may display a same color among the red, green, and blue colors, one pixel of the first or second pixels may receive a high signal generated based on the first gamma curve, and the other pixel of the first or second pixels may receive a low signal generated based on the second gamma curve. The pixel groups may be arranged in a row direction and a column direction, and the first and second pixel groups may be alternately arranged with each other in each pixel row.

Each pixel row may include a first sub-pixel row and a second sub-pixel row, and the first and second pixels maybe arranged in different sub-pixel rows of the first and second sub-pixel rows. A plurality of first pixel may be provided, each of the first pixels arranged in the first sub-pixel row, and a plurality of second pixels may be provided and arranged in the second sub-pixel row.

The first pixels may include first positive pixels having a positive polarity and first negative pixels having a negative polarity, and the second pixels may include second positive pixels having the positive polarity and second negative pixels having the negative polarity. A number of the first positive pixels may be equal to a number of the first negative pixels in the first sub-pixel row, and a number of the second positive pixels may be equal to a number of the second negative pixels in the second sub-pixel row.

The display apparatus may include a plurality of gate lines extending in the row direction; and a plurality of data lines extending in the column direction, wherein the pixels of the first sub-pixel row are connected to a k-th gate line among the gate lines and the pixels of the second sub-pixel row are connected to a (k+1)th gate line among the gate lines. The pixels in a j-th column may be disposed between an i-th data line and an (i+1)th data line among the data lines are arranged in the column direction, and the pixels in the j-th column may be connected to one of the i-th data line and the (i+1)th data line. All pixels in the j-th column may be connected to the i-th data line.

Among the pixels arranged in the j-th column, the pixels arranged in the first sub-pixel row may be connected to the i-th data line and the pixels arranged in the second sub-pixel row are connected to the (i+1)th data line. A polarity of the pixel signal may be applied to the data lines is inverted every four data lines.

At least one pixel of the red, green, or blue pixels of the first pixel group may have a gamma characteristic corresponding to the first gamma curve, other pixels of the red, green, or blue pixels of the first pixel group may have a gamma characteristic corresponding to the second gamma curve, at least one pixel of the red, green, or blue pixels of the second pixel group may have the gamma characteristic corresponding to the second gamma curve, and other pixels of the red, green, or blue pixels of the second pixel group may have the gamma characteristic corresponding to the first gamma curve.

Each of the primary color pixels and each of the white pixels may be divided into a high gray-scale area and a low gray-scale area. The high gray-scale area may have the gamma characteristic corresponding to the first gamma curve and the low gray-scale area may have the gamma characteristic corresponding to a third gamma curve having a brightness value lower than the first gamma curve with respect to the same gray-scale in the pixel applied with the pixel signal based on the first gamma curve among the primary color pixels and the white pixels, and the high gray-scale area may have the gamma characteristic corresponding to the second gamma curve and the low gray-scale area may have the gamma characteristic corresponding to a fourth gamma curve having a brightness value lower than the second gamma curve with respect to the same gray-scale in the pixel applied with the pixel signal based on the second gamma curve among the primary color pixels and the white pixels. The first and second gamma curves may have different brightness values from each other with respect to the same gray-scale.

The first and second pixel groups may be alternately arranged in a row direction and a column direction and disposed adjacent to each other. A first pixel of the first pixel group and a second pixel of the second pixel group may display a same color of the red, green, or blue colors, one pixel of the first or second pixels may receive a high signal may be generated based on the first gamma curve, and the other pixel of the first or second pixels may receive a low signal generated on the basis of the second gamma curve. The first and second pixels maybe alternately arranged in the unit of pixel along the same pixel row and the same pixel column.

In accordance with one or more other embodiments, a display apparatus includes a plurality of primary color pixels, wherein at least one of the primary color pixels including a white area and wherein the primary color pixels include: a first pixel to operate based on a first gamma curve; and a second pixel to operate based on a second gamma curve. The white area of the first pixel may have a gamma characteristic corresponding to the first gamma curve, and the white area of the second pixel may have a gamma characteristic corresponding to the second gamma curve.

Each of the primary color pixels maybe divided into a high gray-scale area and a low gray-scale area. The high gray-scale area may correspond to an area in which the primary color is displayed and the low gray-scale area may correspond to the white area. The high gray-scale area may have a gamma characteristic corresponding to the first gamma curve in the first pixel, the low gray-scale area may have a gamma characteristic corresponding to a third gamma curve having a brightness value lower than the first gamma curve in the first pixel with the same gray-scale, the high gray-scale area may have a gamma characteristic corresponding to the second gamma curve in the second pixel, and the low gray-scale area may have a gamma characteristic corresponding to a fourth gamma curve having a brightness value lower than the second gamma curve in the second pixel with respect to the same gray-scale.

In accordance with one or more other embodiments, a display apparatus includes a plurality of primary color pixels, each including: a high gray-scale area and a low gray-scale area, wherein the low gray-scale area of a first pixel of the primary color pixels corresponds to a first white area and the high gray-scale area of a second pixel of the primary color pixels corresponds to a second white area. The high gray-scale area of the first and second pixels may have a gamma characteristic corresponding to a first gamma curve, and the low gray-scale area of the first and second pixels may have a gamma characteristic corresponding to a second gamma curve having a brightness value lower than the first gamma curve with respect to a same gray-scale. The first and second white areas may be alternately arranged in a row direction and a column direction.

In accordance with one or more other embodiments, a display apparatus includes a plurality of primary color pixels; and a plurality of white pixels, wherein each of the white pixels includes a first area to display light of the white color and a second area to display light of a primary color, and wherein the white pixels include a first white pixel to receive a first white pixel signal generated based on a first gamma curve and a second white pixel to receive a second white pixel signal generated based on a second gamma curve.

The primary color pixels may include red, green, and blue color pixels, and the second area may display light of at least one of red, green, or blue colors. The first white pixel may include a first area to display the white color and a second area to display the primary color, and the second white pixel may include only the first area displaying the white color.

The first and second gamma curves may have different brightness values from each other with respect to a same gray-scale. The primary color pixels and the white pixels may form a plurality of pixel groups, the pixel groups including a first pixel group and a second pixel group, the first pixel group may include the first white pixel and the second pixel group may include the second white pixel, the first and second pixel groups adjacent to each other.

In accordance with one or more other embodiments, a display apparatus includes a timing controller to receive an input image data, convert the input image data to a primary color data and a white data, and convert the white data to first and second white pixel data on the basis of first and second gamma curves; a driver to convert the first and second white pixel data to first and second white pixel voltages; and a display panel including primary color pixels and white pixels, the white pixels including a first white pixel applied with the first white pixel voltage and a second white pixel applied with the second white pixel voltage.

The display apparatus may include a first look-up table to store a first sampling data sampled from the first gamma curve; and a second look-up table to store a second sampling data sampled from the second gamma curve. The primary color data includes red, green, and blue color data, and the timing controller may convert each of the red, green, and blue color data to a high pixel data and a low pixel data with reference to the first and second look-up tables.

The first gamma curve may have a brightness value higher than a reference gamma curve with respect to a same gray-scale, and the second gamma curve may have a brightness value lower than the reference gamma curve with respect to the same gray-scale. The first gamma curve may include first and second sub-gamma curves having different brightness values with respect to the same gray-scale, the second gamma curve may include third and fourth sub-gamma curves having different brightness values with respect to the same gray-scale, the primary color data may be converted to a first primary pixel data based on the first sub-gamma curve, the white color data may be converted to the first white pixel data based on the second sub-gamma curve, the primary color data may be converted to a second primary pixel data based on the third sub-gamma curve, and the white color data may be converted to the second white pixel data based on the fourth sub-gamma curve.

The primary color pixels and the white pixels may form pixel groups, the pixel groups may include a first pixel group and a second pixel group, the first pixel group may include the first white pixel, the second pixel group may include the second white pixel, and the first and second pixel groups may be adjacent to each other.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
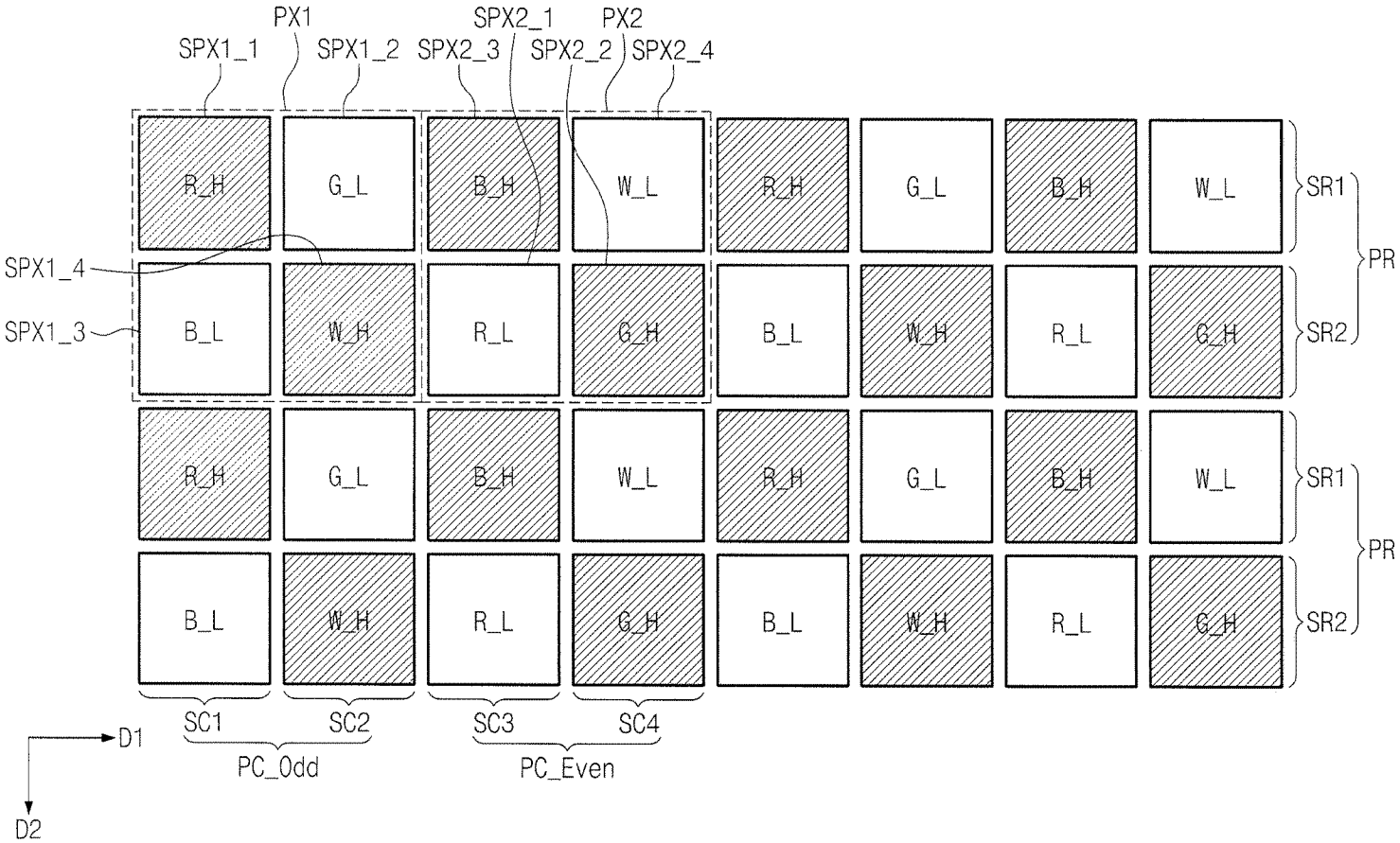
FIG. 1 illustrates an embodiment of a pixel arrangement.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

FIG. 1 illustrates an embodiment of an arrangement of pixels of a display apparatus. Referring to FIG. 1, the display apparatus includes a display panel with a plurality of pixel groups. The pixel groups are arranged in a matrix form along a first direction D1 and a second direction D2 substantially perpendicular to the first direction D1. Among the pixel groups, a set of the pixel groups sequentially arranged in the first direction D1 is referred to as a pixel row PR and a set of the pixel groups sequentially arrange in the second direction D2 is referred to as a pixel column PC_Odd and PC_Even. The display apparatus includes a plurality of pixel rows PR and a plurality of pixel columns PC_Odd and PC_Even.

Among the pixel groups, a first pixel group PX1 has a 4-pixel structure including first, second, third, and fourth pixels SPX1_1, SPX1_2, SPX1_3, and SPX1_4, and a second pixel group PX2 has a 4-pixel structure including fifth, sixth, seventh, and eighth pixels SPX2_1, SPX2_2, SPX2_3, and SPX2_4. A plurality of first and second pixel groups PX1 and PX2 are provided in each pixel row PR. The first pixel groups PX1 are alternately arranged with the second pixel groups PX2 in each pixel row PR. That is, the first and second pixel groups PX1 and PX2 are disposed right adjacent to each other in at least one direction of the first and second directions D1 and D2. In FIG. 1, the second pixel group PX2 is disposed right adjacent to the first pixel group PX1 in the first direction D1.

Each pixel row PR includes first and second sub-pixel rows SR1 and SR2. The first and second pixels SPX1_1 and SPX1_2 of the first pixel groups PX1 are arranged in the first sub-pixel row SR1 and the third and fourth pixels SPX1_3 and SPX1_4 of the first pixel groups PX1 are arranged in the second sub-pixel row SR2. On the contrary, the seventh and eighth pixels SPX2_3 and SPX2_4 of the second pixel groups PX2 are arranged in the first sub-pixel row SR1 and the fifth and sixth pixels SPX2_1 and SPX2_2 of the second pixel groups PX2 are arranged in the second sub-pixel row SR2.

As an example, among the pixel columns PC_Odd and PC_Even, an odd-numbered pixel column PC_Odd includes the set of the first pixel groups PX1 and an even-numbered pixel column PC_Even includes the set of the second pixel groups PX2. The odd-numbered pixel column PC_Odd includes first and second sub-pixel columns SC1 and SC2. The first and third pixels SPX1_1 and SPX1_3 of the first pixel groups PX1 are alternately arranged with each other in the first sub-pixel column SC1. The second and fourth pixels SPX1_2 and SPX1_4 of the first pixel groups PX1 are alternately arranged with each other in the second sub-pixel column SC2. The even-numbered pixel column PC_Even includes third and fourth sub-pixel columns SC3 and SC4. The fifth and seventh pixels SPX2_1 and SPX2_3 of the second pixel groups PX2 are alternately arranged with each other in the third sub-pixel column SC3. The sixth and eighth pixels SPX2_2 and SPX2_4 of the second pixel groups PX2 are alternately arranged with each other in the fourth sub-pixel column SC4.

In the first and second pixel groups PX1 and PX2, each of the first, second, third, fifth, sixth, and seventh pixels SPX1_1, SPX1_2, SPX1_3, SPX2_1, SPX2_2, and SPX2_3 displays at least one of primary colors (e.g., one of three primary colors) and each of the fourth and eighth SPX1_4 and SPX2_4 displays a color (e.g., a white color, a yellow color, etc.) other than the primary colors. In detail, each of the first, second, third, fifth, sixth, and seventh pixels SPX1_1, SPX1_2, SPX1_3, SPX2_1, SPX2_2, and SPX2_3 includes a red, green, or blue color filter.

As an example, in the first pixel group PX1, the first pixel SPX1_1 displays a red color, the second pixel SPX1_2 displays a green color, the third pixel SPX1_3 displays a blue color, and the fourth pixel SPX1_4 displays a white color. In the second pixel group PX2, the fifth pixel SPX2_1 displays the red color, the sixth pixel SPX2_2 displays the green color, the seventh pixel SPX2_3 displays the blue color, and the eighth pixel SPX2_4 displays the white color.

Hereinafter, for the convenience of explanation, the first to fourth pixels SPX1_1 to SPX1_4 of the first pixel group PX1 are respectively referred to as a first red pixel, a first green pixel, a first blue pixel, and a first white pixel. In addition, the fifth to eighth pixels SPX2_1 to SPX2_4 of the second pixel group PX2 are respectively referred to as a second red pixel, a second green pixel, a second blue pixel, and a second white pixel.

In the first pixel group PX1, the first red pixel SPX1_1 and the first white pixel SPX1_4 are in a diagonal position and the first green pixel SPX1_2 and the first blue pixel SPX1_3 are in a diagonal position. The first red pixel SPX1_1 and the first green pixel SPX1_2 are arranged in the first sub-pixel row SR1 and are adjacent to each other in the first direction D1. The first red pixel SPX1_1 and the first blue pixel SPX1_3 are arranged in the same pixel column (e.g., the odd-numbered pixel column PC_Odd) and are adjacent to each other in the second direction D2.

The first red pixel SPX1_1 and the first white pixel SPX1_4 are respectively applied with a red high voltage R_H and a white high voltage W_H, which are generated based on a first gamma curve. The first green pixel SPX1_2 and the first blue pixel SPX1_3 are respectively applied with a green low voltage G_L and a blue low voltage B_L, which are generated based on a second gamma curve.

In the second pixel group PX2, the second red pixel SPX2_1 and the second white pixel SPX2_4 are in a diagonal position and the second green pixel SPX2_2 and the second blue pixel SPX2_3 are in a diagonal position. The second red pixel SPX2_1 and the second green pixel SPX2_2 are arranged in the second sub-pixel row SR2 and are adjacent to each other in the first direction D1. The second red pixel SPX2_1 and the second blue pixel SPX2_3 are arranged in the same pixel column (e.g., the even-numbered pixel column PC_Even) and are adjacent to each other in the second direction D2.

The second red pixel SPX2_1 and the second white pixel SPX2_4 are respectively applied with a red low voltage R_L and a white low voltage W_L, which are generated based on the second gamma curve. The second green pixel SPX2_2 and the second blue pixel SPX2_3 are respectively applied with a green high voltage G_H and a blue high voltage B_H, which are generated based on the first gamma curve.

Accordingly, high pixels applied with the first gamma curve (e.g., the first red pixel SPX1_1 and the second blue pixel SPX2_1) are alternately arranged with low pixels applied with the second gamma curve (e.g., the first green pixel SPX1_2 and the second white pixel SPX2_4) in the first sub-pixel row SR1. In addition, high pixels applied with the first gamma curve (e.g., the first white pixel SPX1_4 and the second green pixel SPX2_2) are alternately arranged with the low pixels applied with the second gamma curve (e.g., the first blue pixel SPX1_3 and the second red pixel SPX2_1) in the second sub-pixel row SR2.

The high pixels SPX1_1 and SPX2_1 are respectively arranged in the odd-numbered sub-pixel columns SC1 and SC3 in the first sub-pixel row SR1. The high pixels SPX1_4 and SPX2_2 are respectively arranged in the even-numbered sub-pixel columns SC2 and SC4 in the second sub-pixel row SR2. The low pixels SPX1_2 and SPX2_4 are respectively arranged in the even-numbered sub-pixels SC2 and SC4 in the first sub-pixel row SR1. The low pixels SPX1_3 and SPX2_1 are respectively arranged in the odd-numbered sub-pixel columns SC1 and SC3 in the second sub-pixel row SR2.

Therefore, in this embodiment, the high pixels SPX1_1, SPX1_4, SPX2_3, and SPX2_2 are arranged in zigzag shape along the first and second directions D1 and D2. Also, in this embodiment, the low pixels SPX1_3, SPX1_2, SPX2_1, and SPX2_4 are arranged in zigzag shape along the first and second directions D1 and D2.

As described above, as viewed relative to the pixels having the same color, the high pixels SPX1_1, SPX1_4, SPX2_3, and SPX2_2 operated on the basis of the first gamma curve are spatially separately from the low pixels SPX1_3, SPX1_2, SPX2_1, and SPX2_4 operated on the basis of the second gamma curve. Thus, the display apparatus may achieve improved side visibility without employing a visible pixel structure in which each pixel is divided into two gray-scale areas.

For example, as viewed relative to the white color, the first white pixel SPX1_4 operated on the basis of the first gamma curve is in a second row and a second column and in the second row and a sixth column. The second white pixel SPX2_4 operated on the basis of the second gamma curve is in a first row and a fourth column and in the first row and an eighth column.

The 4-pixel structure, in which the white pixels having the white color are added to each pixel group, improves the whole brightness of the display apparatus, but a yellowish phenomenon may occur when viewed in a side surface of the display apparatus. In this case, the white pixels having the white color may be operated as the first white pixel SPX1_4 based on the first gamma curve and the second white pixel SPX2_4 based on the second gamma curve, which are spatially separated from each other. Accordingly, the yellowish phenomenon may be prevented from occurring at the side surface and the whole side visibility of the display apparatus having the 4-pixel structure may be improved.

FIG. 1 shows the pixels operated on the basis of the first or second gamma curve during one frame period. However, when the frame is changed, the gamma curve applied to the pixels is changed. For example, the high pixels, which receive the high voltage based on the first gamma curve during an n-th frame period, receive the low voltage based on the second gamma curve during an (n+1)th frame period. On the contrary, the low pixels, which receive the low voltage based on the second gamma curve during the n-th frame period, receive the high voltage based on the first gamma curve during the (n+1)th frame period. In addition, the period of the change of the gamma curve with respect to the pixel should not be limited to one frame, and the gamma curve may be changed in the unit of two or three frame periods.

Here and in the following figures, for the sake of explanation, the arrangement relation between the high pixels and the low pixels has been shown.

The arrangement order of the pixels in the 4-pixel structure should not be limited to that shown in FIG. 1. For example, the positions of the first red, first green, first blue, and first white pixels SPX1_1, SPX1_2, SPX1_3, and SPX1_4 and the positions of the second red, second green, second blue, and second white pixels SPX2_1, SPX2_2, SPX2_3, and SPX2_4 may be different in the first pixel group PX1 in another embodiment.

Also, in FIG. 1, the first and second pixel groups PX1 and PX2 are alternately arranged in the first direction D1. In another embodiment, the first and second pixel groups PX1 and PX2 may be alternately arranged in the second direction D2 or in, for example, two rows or three or more rows along the second direction D2.

The display panel is described as a liquid crystal display panel. In this case, the display apparatus further includes a backlight unit disposed at a rear surface of the display panel. The backlight unit is disposed at the rear surface of the display panel and generates a light. The backlight unit includes a light emitting diode or a cold cathode fluorescent lamp as its light source. In another embodiment, the display panel may be another type of panel, e.g., an organic electroluminescent device or an electrophoretic device.

Figure 2:
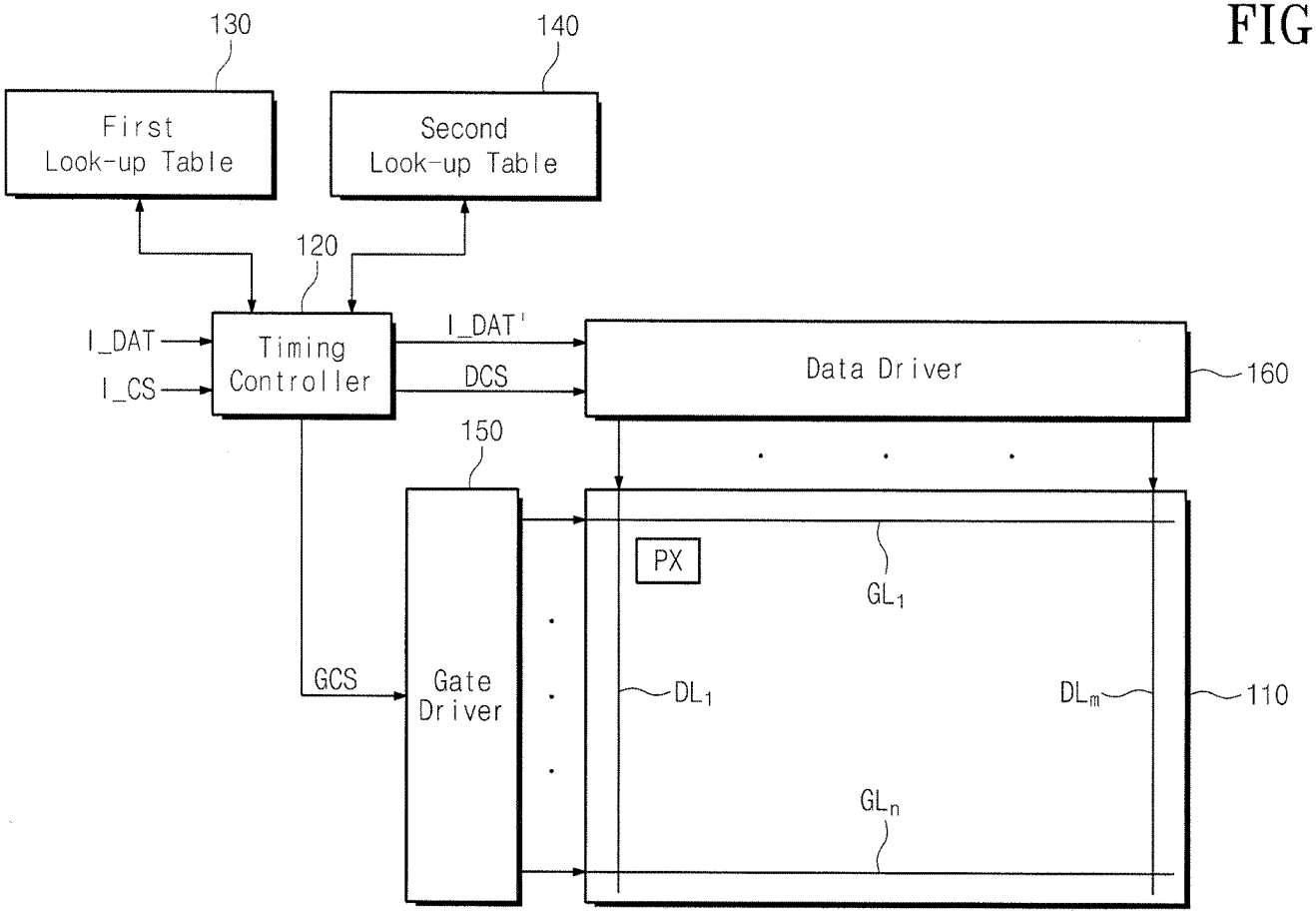
FIG. 2 illustrates an embodiment of a display apparatus.
Figure 3:
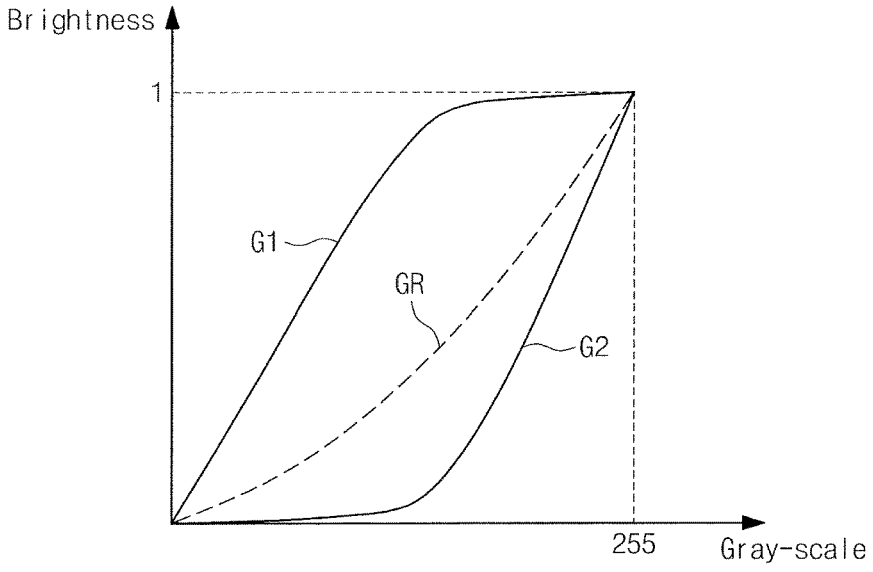
FIG. 3 illustrates examples of stored gamma curves.

FIG. 2 illustrates an embodiment of a display apparatus 100, and FIG. 3 is a graph including examples of first and second gamma curves respectively stored in first and second look-up tables 130 and 140 in FIG. 2. Referring to FIGS. 2 and 3, the display apparatus 100 includes a display panel 110, a timing controller 120, the first and second look-up tables 130 and 140, a gate driver 150, and a data driver 160.

The display panel 110 includes a plurality of pixel groups PX, each having a 4-pixel structure configured to include red, green, blue, and white pixels.

The timing controller 120 receives input image data I_DAT and an image control signal I_CS from an external image board in the unit of frame. The first look-up table 130 stores a first sampling data sampled from the first gamma curve G1 shown in FIG. 3 and the second look-up table 140 stores a second sampling data sampled from the second gamma curve G2 shown in FIG. 3.

In FIG. 3, an x-axis indicates a gray-scale level and a y-axis indicates brightness (or transmittance (%)). The first gamma curve G1 has the brightness higher than that of the second gamma curve G2 with respect to the same gray-scale level.

In FIG. 3, a reference gamma curve GR that indicates an optimum front visibility. For instance, the reference gamma curve GR has a gamma value of about 2.2. The first gamma curve G1 has the brightness higher than that of the reference gamma curve GR and the second gamma curve G2 has the brightness lower than that of the reference gamma curve GR with respect to the same gray-scale level. Here, the first and second gamma curves G1 and G2 may be gamma curves optimized to the side visibility in the 4-pixel structure. The first and second gamma curves G1 and G2 may be generated such that the reference gamma curve GR is obtained by synthesizing the first and second gamma curves G1 and G2. In another embodiment, the first and second gamma curves G1 and G2 may have a different form or shape.

When the display panel displays the image using data converted on the basis of the second gamma curve G2, the brightness of the image displayed in the display panel is lower than that of the image displayed using data converted on the basis of the first gamma curve G1. The first look-up table 130 stores high gray-scale brightness data extracted from the first gamma curve G1 in predetermined reference gray-scales as the first sampling data. The second look-up table 140 stores low gray-scale brightness data extracted from the second gamma curve G2 in predetermined reference gray-scales as the second sampling data.

The timing controller 120 receives the first and second sampling data from the first and second look-up tables 130 and 140 and converts the input image data I_DAT. The input image data I_DAT includes red, green, and blue image data R, G, and B. The converted image data I_DAT' generated by the timing controller 120 is applied to the data driver 160. The converted image data I_DAT' includes data information about the 4-pixel structure and information about the gamma curve.

Figure 4:
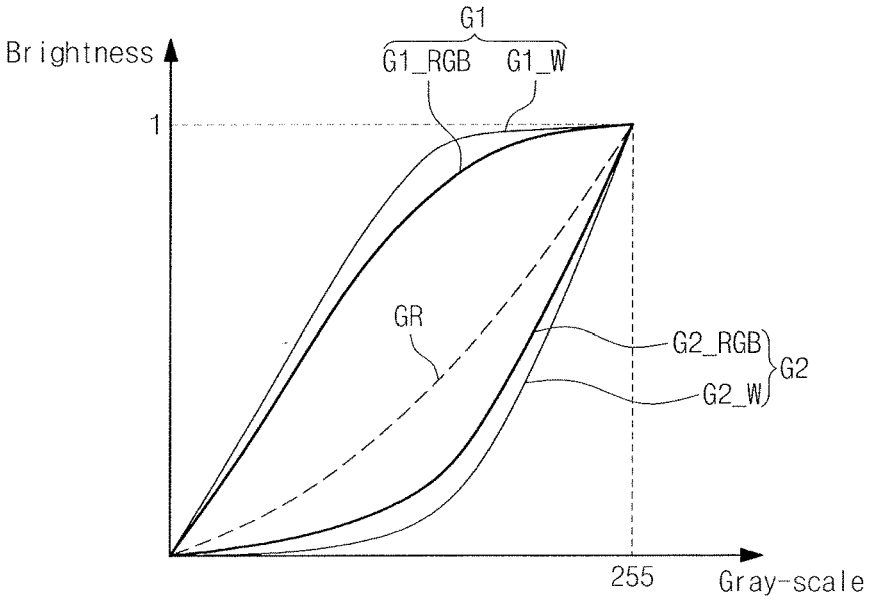
FIG. 4 illustrates other examples of stored gamma curves.

FIG. 4 illustrates other examples of first and second gamma curves G1 and G2. Referring to FIG. 4, the first gamma curve G1 includes a first sub-gamma curve G1_RGB and a second sub-gamma curve G1_W, and the second gamma curve G2 includes a third sub-gamma curve G2_RGB and a fourth sub-gamma curve G2_W.

The first and second sub-gamma curves G1_RGB and G1_W have the brightness higher than that of the reference gamma curve GR with respect to the same gray-scale level. The third and fourth sub-gamma curves G2_RGB and G2_W have the brightness lower than that of the reference gamma curve GR with respect to the same gray-scale level. As an example, the second sub-gamma curve G1_W has the brightness higher than that of the first sub-gamma curve G1_RGB with respect to the same gray-scale level. The fourth sub-gamma curve G2_W has the brightness lower than that of the third sub-gamma curve G2_RGB with respect to the same gray-scale level.

The red, green, and blue data R, G, and B are respectively converted to red, green, and blue high voltages R_H, G_H, and B_H on the basis of the first sub-gamma curve G1_RGB. The white data is converted to a white high voltage W_H on the basis of the second sub-gamma curve G1_W. In addition, the red, green, and blue data R, G, and B are respectively converted to red, green, and blue low voltages R_L, G_L, and B_L on the basis of the third sub-gamma curve G2_RGB. The white data is converted to a white low voltage W_L on the basis of the fourth sub-gamma curve G2_W.

As shown in FIG. 4, the gamma curve applied to the red, green, and blue data R, G, and B is different from the gamma curve applied to the white data. In another embodiments, one or more different gamma curves may be used but the present disclosure embodiment should not be limited to the gamma curves shown in FIG. 4.

Figure 5:
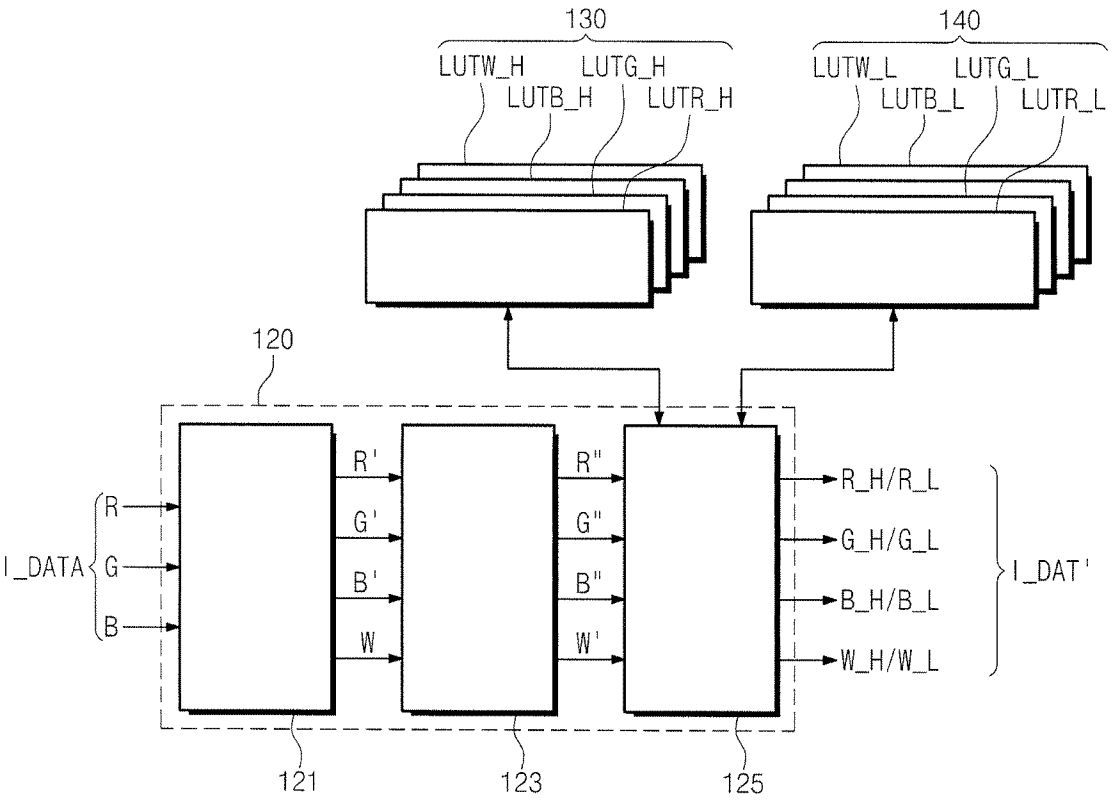
FIG. 5 illustrates an embodiment of a timing controller.

FIG. 5 illustrates an embodiment of a timing controller 120 and the first and second look-up tables in FIG. 2. Referring to FIG. 5, the timing controller 120 includes a gamma mapping part 121, a rendering part 123, and a gamma converting part 125.

The gamma mapping part 121 receives the red, green, and blue input image data R, G, and B as the input image data I_DAT. The gamma mapping part 121 maps a RGB gamut of the red, green, and blue image data R, G, and B to a RGBW gamut using a gamut mapping algorithm (GMA) to generate red, green, blue, and white image data R', G', B', and W. The red, green, blue, and white image data R', G', B', and W are applied to the rendering part 123 to perform a rendering operation.

For the rendering operation, the rendering part 123 may perform a re-sample filtering operation and a sharp filtering operation. The re-sample filtering operation converts data, which are applied to a target pixel, among the red, green, blue, and white image data R', G', B', and W on the basis of data corresponding to the target pixel and neighboring pixels disposed adjacent to the target pixel. The sharp filtering operation detects shape of the image (e.g., lines, edges, dots, diagonal lines, etc.) and position of the image on the basis of the red, green, blue, and white image data R', G', B', and W and compensates for the red, green, blue, and white image data R', G', B', and W on the basis of the detected data.

The rendering part 123 performs the above-mentioned rendering operation to convert the red, green, blue, and white image data R', G', B', and W to red, green, blue, and white pixel data R", G", B", and W'.

The gamma converting part 125 converts each of the red, green, blue, and white pixel data R", G", B", and W' to data having two gamma characteristics with reference to the first and second look-up tables 130 and 140.

The first look-up table 130 includes a first red look-up table LUTR_H, a first green look-up table LUTG_H, a first blue look-up table LUTB_H, and a first white look-up table LUTW_H. The first sampling data, which are used such that the red, green, blue, and white pixel data R", G", B", and W' are converted to have the brightness corresponding to the first gamma curve G1, are stored in the first red, first green, first blue, and first white look-up tables LUTR_H, LUTG_H, LUTB_H, and LUTW_H according to their colors.

The second look-up table 140 includes a second red look-up table LUTR_L, a second green look-up table LUTG_L, a second blue look-up table LUTB_L, and a second white look-up table LUTW_L. The second sampling data, which are used such that the red, green, blue, and white pixel data R", G", B", and W' are converted to have the brightness corresponding to the second gamma curve G2, are stored in the second red, second green, second blue, and second white look-up tables LUTR_L, LUTG_L, LUTB_L, and LUTW_L according to their colors.

For example, the gamma converting part 125 converts the red pixel data R" to the red high data R_H and the red low data R_L with reference to the first and second red look-up tables LUTR_H and LUTR_L. The gamma converting part 125 converts the green pixel data G" to the green high data G_H and the green low data G_L with reference to the first and second green look-up tables LUTG_H and LUTG_L. The gamma converting part 125 converts the blue pixel data B" to the blue high data B_H and the blue low data B_L with reference to the first and second blue look-up tables LUTB_H and LUTB_L. The gamma converting part 125 converts the white pixel data W' to the white high data W_H and the white low data W_L with reference to the first and second white look-up tables LUTW_H and LUTW_L.

The converted image data I_DAT' by the gamma converting part 125 is applied to the data driver 160.

The timing controller 120 generates a gate control signal GCS and a data control signal DCS in response to the image control signal I_CS and applies the gate control signal GCS and the data control signal DCS to the gate driver 150 and the data driver 160, respectively.

The gate driver 150 receives the gate control signal GCS from the timing controller 120 and outputs gate signals to the display panel 110 in response to the gate control signal GCS. The data driver 160 receives the data control signal DCS and the converted image data I_DAT' from the timing controller 120 and outputs data signals to the display panel 110 in response to the data control signal DCS and the converted image data I_DAT'.

The display panel 110 includes a plurality of gate lines $GL_1$ to $GL_n$ applied with the gate signals from the gate driver 150 and a plurality of data lines $DL_1$ to $DL_m$ applied with the data signals from the data driver 160. Accordingly, each of the pixel groups PX disposed on the display panel 110 is connected to corresponding gate lines of the gate lines $GL_1$ to $GL_n$ and corresponding data lines of the data lines $DL_1$ to $DL_m$ and displays the image using the gate and data signals.

Figure 6:
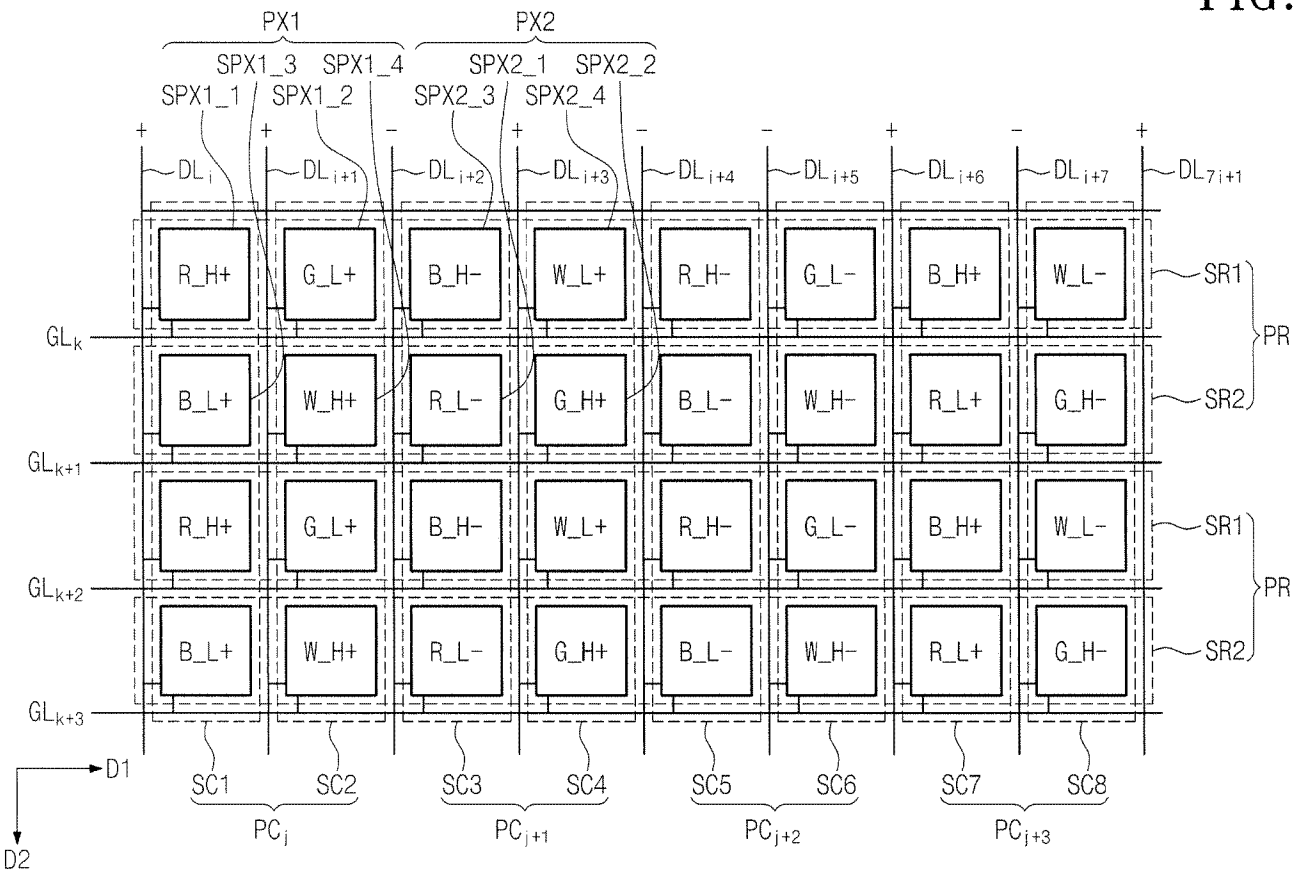
FIG. 6 illustrates an embodiment of pixel groups.

FIG. 6 illustrates an embodiment of pixel groups of a display apparatus which includes a plurality of gate lines $GL_k$ to $GL_{k+3}$ extending in the first direction D1 and a plurality of data lines $DL_i$ to $DL_{i+7}$ extending in the second direction D2.

Each pixel row PR is connected to two gate lines (hereinafter, referred to as k-th and (k+1)th gate lines $GL_k$ and $GL_{k+1}$), which are adjacent to each other, among the gate lines $GL_k$ to $GL_{k+3}$ ("k" is a natural number equal to or greater than 1). For example, the first sub-pixel row SR1 is connected to the k-th gate line $GL_k$ of each pixel row PR and the second sub-pixel row SR2 is connected to the (k+1)th gate line $GL_{k+1}$ of each pixel row PR.

A j-th pixel column $PC_j$ ("j" is an odd number equal to or greater than 1) is connected to two data lines (hereinafter, referred to as i-th and (i+1)th data lines $DL_i$ and $DL_{i+1}$), which are adjacent to each other, among the data lines $DL_i$ to $DL_{i+7}$ ("i" is an odd number equal to or greater than). For example, a first sub-pixel column SC1 of the j-th pixel column $PC_j$ is between the i-th and (i+1)th data lines $DL_i$ and $DL_{i+1}$ and connected to at least one of the i-th and (i+1)th data lines $DL_i$ and $DL_{i+1}$. A second sub-pixel column SC2 of the j-th pixel column $PC_j$ is between the (i+1)th and (i+2)th data lines $DL_{i+1}$ and $DL_{i+2}$ and connected to at least one of the (i+1)th and (i+2) data lines $DL_{i+1}$ and $DL_{i+2}$.

In FIG. 6, as an example, pixels (e.g., the first red pixel SPX1_1 and the first blue pixel SPX1_3) of the first sub-pixel column SC1 are connected to the i-th data line $DL_i$. Pixels (e.g., the first green pixel SPX1_2 and the first white pixel SPX1_4) of the second sub-pixel column SC2 are connected to the (i+1)th data line $DL_{i+1}$.

A (j+1)th pixel column $PC_{j+1}$ is connected to two data lines (hereinafter, referred to as (i+2)th and (i+3)th data lines $DL_{i+2}$ and $DL_{i+3}$), which are adjacent to each other, among the data lines $DL_i$ to $DL_{i+7}$. For example, a third sub-pixel column SC3 of the (j+1)th pixel column $PC_{j+1}$ is disposed between the (i+2)th and (i+3)th data lines $DL_{i+2}$ and $DL_{i+3}$ and connected to at least one of the (i+2)th and (i+3)th data lines $DL_{i+2}$ and $DL_{i+3}$. A fourth sub-pixel column SC4 of the (j+1)th pixel column $PC_{j+1}$ is disposed between the (i+3)th and (i+4)th data lines $DL_{i+3}$ and $DL_{i+4}$ and connected to at least one of the (i+3)th and (i+4) data lines $DL_{i+3}$ and $DL_{i+4}$.

In FIG. 6, as an example, pixels (e.g., the second red pixel SPX2_1 and the second blue pixel SPX2_3) of the third sub-pixel column SC3 are connected to the (i+2)th data line $DL_{i+2}$. Pixels (e.g., the second green pixel SPX2_2 and the second white pixel SPX2_4) of the fourth sub-pixel column SC4 are connected to the (i+3)th data line $DL_{i+3}$.

A (j+2)th pixel column $PC_{j+2}$ is connected to two data lines (hereinafter, referred to as (i+4)th and (i+5)th data lines $DL_{i+4}$ and $DL_{i+5}$), which are adjacent to each other, among the data lines $DL_i$ to $DL_{i+7}$. For example, a fifth sub-pixel column SC5 of the (j+2)th pixel column $PC_{j+2}$ is between the (i+4)th and (i+5)th data lines $DL_{i+4}$ and $DL_{i+5}$ and connected to at least one of the (i+4)th and (i+5)th data lines $DL_{i+4}$ and $DL_{i+5}$. A sixth sub-pixel column SC6 of the (j+2)th pixel column $PC_{j+2}$ is between the (i+5)th and (i+6)th data lines $DL_{i+5}$ and $DL_{i+6}$ and connected to at least one of the (i+5)th and (i+6) data lines $DL_{i+5}$ and $DL_{i+6}$.

In FIG. 6, as an example, pixels, i.e., the first red pixel SPX1_1 and the first blue pixel SPX1_3, of the fifth sub-pixel column SC5 are connected to the (i+4)th data line $DL_{i+4}$. Pixels (e.g., the first green pixel SPX1_2 and the first white pixel SPX1_4) of the sixth sub-pixel column SC6 are connected to the (i+5)th data line $DL_{i+5}$.

A (j+3)th pixel column $PC_{j+3}$ is connected to two data lines (hereinafter, referred to as (i+6)th and (i+7)th data lines $DL_{i+6}$ and $DL_{i+7}$), which are adjacent to each other, among the data lines $DL_i$ to $DL_{i+7}$. That is, a seventh sub-pixel column SC7 of the (j+3)th pixel column $PC_{j+3}$ is between the (i+6)th and (i+7)th data lines $DL_{i+6}$ and $DL_{i+7}$ and connected to at least one of the (i+6)th and (i+7)th data lines $DL_{i+6}$ and $DL_{i+7}$. An eighth sub-pixel column SC8 of the (j+3)th pixel column $PC_{j+3}$ is between the (i+7)th and (7i+1)th data lines $DL_{i+7}$ and $DL_{7i+1}$ and connected to at least one of the (i+7)th and (7i+1) data lines $DL_{i+7}$ and $DL_{7i+1}$.

In FIG. 6, as an example, pixels (e.g., the second red pixel SPX2_1 and the second blue pixel SPX2_3) of the seventh sub-pixel column SC7 are connected to the (i+6)th data line $DL_{i+6}$. Pixels (e.g., the second green pixel SPX2_2 and the second white pixel SPX2_4) of the eighth sub-pixel column SC8 are connected to the (i+7)th data line $DL_{i+7}$.

In each pixel row PR, the first red pixel SPX1_1 and the first green pixel SPX1_2 of the first pixel group PX1 are connected to the odd-numbered gate lines $GL_k$ and $GL_{k+2}$ and the first blue pixel SPX1_3 and the first white pixel SPX1_4 of the first pixel group PX1 are connected to the even-numbered gate lines $GL_{k+1}$ and $GL_{k+3}$. In each pixel row PR, the second red pixel SPX2_1 and the second green pixel SPX2_2 of the second pixel group PX2 are connected to the even-numbered gate lines $GL_{k+1}$ and $GL_{k+3}$ and the second blue pixel SPX2_3 and the second white pixel SPX2_4 of the second pixel group PX2 are connected to the odd-numbered gate lines $GL_k$ and $GL_{k+2}$.

In FIG. 6, the pixels applied with a positive (+) data voltage during an n-th ("n" is a natural number equal to or greater than 1) frame are further indicated by a positive mark "+", and the pixels applied with a negative (−) data voltage during the n-th frame are further indicated by a negative mark "−". The polarity of the data voltage is determined with respect to a common voltage that is a reference voltage. For instance, when the data voltage is greater than the common voltage, the data voltage has the positive (+) polarity, and when the data voltage is smaller than the common voltage, the data voltage has the negative (−) polarity.

The polarity of the data voltage applied to each pixel in shown in FIG. 6 indicates the polarity during the n-th frame. Therefore, when the n-th frame is changed to the (n+1)th frame, the polarity of the data voltage applied to each pixel is inverted. That is, the data driver 160 shown in FIG. 2 inverts the polarities of the data voltages applied to the data lines $DL_i$ to $DL_{i+7}$ every frame.

In the present exemplary embodiment, the positive (+) data voltage is applied to the i-th, (i+1)th, and (i+3)th data lines $DL_i$, $DL_{i+1}$, and $DL_{i+3}$ and the negative (−) data voltage is applied to the (i+2)th data line $DL_{i+2}$. The polarity of the data voltage applied to the data lines $DL_i$ to $DL_{i+7}$ is inverted every four data lines. For instance, the i-th to (i+3)th data lines $DL_i$ to $DL_{i+3}$ are respectively applied with the data voltages having +, +, −, and + polarities, and the (i+4)th to (i+7)th data lines $DL_{i+4}$ to $DL_{i+7}$ are respectively applied with the data voltages having −, −, +, and − polarities.

In addition, the high gray-scale voltage H, which is converted on the basis of the first gamma curve G1 (e.g., shown in FIG. 3), is applied to odd-numbered data lines, e.g., the i-th, (i+2)th, (i+4)th, and (i+6)th data lines $DL_i$, $DL_{i+2}$, $DL_{i+4}$, and $DL_{i+6}$, during the high period of the odd-numbered gate lines $GL_k$ and $GL_{k+2}$ in the n-th frame. Further, the low gray-scale voltage L, which is converted on the basis of the second gamma curve G2 (e.g., shown in FIG. 3), is applied to even-numbered data lines, e.g., the (i+1)th, (i+3)th, (i+5)th, and (i+7)th data lines $DL_{i+1}$, $DL_{i+3}$, $DL_{i+5}$, and $DL_{i+7}$, during the high period of the odd-numbered gate lines $GL_k$ and $GL_{k+2}$ in the n-th frame.

Meanwhile, the low gray-scale voltage L, which is converted on the basis of the second gamma curve G2, is applied to the odd-numbered data lines (e.g., the i-th, (i+2)th, (i+4)th, and (i+6)th data lines $DL_i$, $DL_{i+2}$, $DL_{i+4}$, and $DL_{i+6}$) during the high period of the even-numbered gate lines $GL_{k+1}$ and $GL_{k+3}$ in the n-th frame. Further, the high gray-scale voltage H, which is converted on the basis of the first gamma curve G1, is applied to even-numbered data lines (e.g., the (i+1)th, (i+3)th, (i+5)th, and (i+7)th data lines $DL_{i+1}$, $DL_{i+3}$, $DL_{i+5}$, and $DL_{i+7}$) during the high period of the even-numbered gate lines $GL_{k+1}$ and $GL_{k+3}$ in the n-th frame. For example, the high gray-scale voltage H and the low gray-scale voltage L are alternately applied to the data lines in the unit of one data line and one gate line.

In FIG. 6, the red, green, blue, and white high voltages are respectively indicated by "R_H", "G_H", "B_H", and "W_H", which are obtained by adding color marks (e.g., R, G, B, and W) to the high gray-scale voltage H. In addition, the red, green, blue, and white low voltages are respectively indicated by "R_L", "G_L", "B_L", and "W_L", which are obtained by adding color marks (e.g., R, G, B, and W) to the low gray-scale voltage L.

As shown in FIG. 6, the first red pixel SPX1_1 and the second blue pixel SPX2_3 of the first sub-pixel row SR1 receive the red high voltage R_H and the blue high voltage B_H as the high gray-scale voltage H, respectively. During the n-th frame, the first red pixel SPX1_1 disposed at the j-th pixel column $PC_j$ among the first red pixels SPX1_1 of the first sub-pixel row SR1 receives the positive red high voltage R_H+ and the first red pixel SPX1_1 disposed at the (j+2)th pixel column $PC_{j+2}$ among the first red pixels SPX1_1 of the first sub-pixel row SR1 receives the negative red high voltage R_H−. Among the second blue pixels SPX2_3 of the first sub-pixel row SR1, the second blue pixel SPX2_3 disposed at the (j+1)th pixel column $PC_{j+1}$ receives the negative blue high voltage B_H− during the n-th frame and the second blue pixel SPX2_3 disposed at the (j+3)th pixel column $PC_{j+3}$ receives the positive blue high voltage B_H+ during the n-th frame.

The first green pixel SPX1_2 and the second white pixel SPX2_4 of the first sub-pixel row SR1 receive the green low voltage G_L and the white low voltage W_L as the low gray-scale voltage L, respectively. During the n-th frame, the first green pixel SPX1_2 disposed at the j-th pixel column $PC_j$ among the first green pixels SPX1_2 of the first sub-pixel row SR1 receives the positive green low voltage G_L+ and the first green pixel SPX1_2 disposed at the (j+2)th pixel column $PC_{j+2}$ among the first green pixels SPX1_2 of the first sub-pixel row SR1 receives the negative green low voltage G_L−. Among the second white pixels SPX2_4 of the first sub-pixel row SR1, the second white pixel SPX2_4 disposed at the (j+1)th pixel column $PC_{j+1}$ receives the positive white low voltage W_L+ during the n-th frame and the second white pixel SPX2_4 disposed at the (j+3)th pixel column $PC_{j+3}$ receives the negative white low voltage W_L− during the n-th frame.

As shown in FIG. 6, the first blue pixel SPX1_3 and the second red pixel SPX2_1 of the second sub-pixel row SR2 receive the blue low voltage B_L and the red low voltage R_L as the low gray-scale voltage L, respectively. During the n-th frame, the first blue pixel SPX1_3 disposed at the j-th pixel column $PC_j$ among the first blue pixels SPX1_3 of the second sub-pixel row SR2 receives the positive blue low voltage B_L+ and the first blue pixel SPX1_3 disposed at the (j+2)th pixel column $PC_{j+2}$ among the first blue pixels SPX1_3 of the second sub-pixel row SR2 receives the negative blue low voltage B_L−. Among the second red pixels SPX2_1 of the second sub-pixel row SR2, the second red pixel SPX2_1 disposed at the (j+1)th pixel column $PC_{j+1}$ receives the negative red low voltage R_L− during the n-th frame and the second red pixel SPX2_1 disposed at the (j+3)th pixel column $PC_{j+3}$ receives the positive red low voltage R_L+ during the n-th frame.

The first white pixel SPX1_4 and the second green pixel SPX2_2 of the second sub-pixel row SR2 receive the white high voltage W_H and the green high voltage G_H as the high gray-scale voltage H, respectively. During the n-th frame, the first white pixel SPX1_4 disposed at the j-th pixel column $PC_j$ among the first white pixels SPX1_4 of the second sub-pixel row SR2 receives the positive white high voltage W_H+ and the first white pixel SPX1_4 disposed at the (j+2)th pixel column $PC_{j+2}$ among the first white pixels SPX1_4 of the second sub-pixel row SR2 receives the negative white high voltage W_H−. Among the second green pixels SPX2_2 of the second sub-pixel row SR2, the second green pixel SPX2_2 disposed at the (j+1)th pixel column $PC_{j+1}$ receives the positive green high voltage G_H+ during the n-th frame and the second green pixel SPX2_2 disposed at the (j+3)th pixel column $PC_{j+3}$ receives the negative green high voltage G_H− during the n-th frame.

The first red pixels SPX1_1 applied with the red high voltage R_H are arranged in the first sub-pixel row SR1 and the second red pixels SPX2_1 applied with the red low voltage R_L are arranged in the second sub-pixel row SR2. The number of the first red pixels SPX1_1 having the positive polarity among the first red pixels SPX1_1 in the first sub-pixel row SR1 is equal to the number of the first red pixels SPX1_1 having the negative polarity among the first red pixels SPX1_1 in the first sub-pixel row SR1. Similar to the red pixels, among the pixels having the same color in the first sub-pixel row SR1, the number of the pixels having the positive polarity is equal to the number of the pixels having the negative polarity.

In addition, the number of the second red pixels SPX2_1 having the positive polarity among the second red pixels SPX2_1 in the second sub-pixel row SR2 is equal to the number of the second red pixels SPX2_1 having the negative polarity among the second red pixels SPX2_1 in the second sub-pixel row SR2. Similar to the red pixels, among the pixels having the same color in the second sub-pixel row SR2, the number of the pixels having the positive polarity is equal to the number of the pixels having the negative polarity.

As described above, when the number of the pixels having the positive polarity is equal to the number of the pixels having the negative polarity among the pixels having the same color in one sub-pixel row, a sum of polarities of the pixel voltages applied to the pixels while the one sub-pixel row is driven becomes zero (0), and thus the common voltage is prevented from shifting to a specific polarity.

When the common voltage is shifted to the specific polarity, a difference in brightness occurs between the pixel having the positive polarity and the pixel having the negative polarity. As described above, in the 4-pixel structure, when the number of the pixels having the positive polarity is equal to the number of the pixels having the negative polarity among the pixels having the same color in one sub-pixel row, the brightness difference caused by the shift of the common voltage may be prevented.

The first red pixel SPX1_1 applied with the red high voltage R_H is provided in a plural number in the first sub-pixel row SR1 and the second red pixel SPX2_1 applied with the red low voltage R_L is provided in a plural number in the second sub-pixel row SR2.

In each pixel row PR, the first red pixel SPX1_1 and the second red pixel SPX2_1 are alternately arranged with each other in the first direction D1. The first and second green pixels SPX1_2 and SPX2_2 are alternately arranged with each other along the first direction D1 in each pixel row PR. The first and blue pixels SPX1_3 and SPX2_3 are alternately arranged with each other along the first direction D1 in each pixel row PR.

Accordingly, as viewed relative to the pixels having the same color, the high pixels based on the first gamma curve G1 are spatially separately from the low pixels based on the second gamma curve G2 in the first and second directions D1 and D2. Thus, the display apparatus may achieve improved side visibility without employing the visible pixel structure in which each pixel is divided into two gray-scale areas.

For example, as viewed relative to the white color, the first white pixel SPX1_4 operated on the basis of the first gamma curve G1 is disposed in a second row and a second column and in the second row and a sixth column. The second white pixel SPX2_4 operated on the basis of the second gamma curve G2 is disposed in a first row and a fourth column and in the first row and an eighth column.

The 4-pixel structure, in which the white pixels having the white color are added to each pixel group, improves the whole brightness of the display apparatus, but the yellowish phenomenon may occur when viewed in the side surface. In this case, the white pixels having the white color may be operated as the first white pixel SPX1_4 based on the first gamma curve G1 and the second white pixel SPX2_4 based on the second gamma curve G2, which are spatially separated from each other. Therefore, the yellowish phenomenon may be prevented from occurring at the side surface and the whole side visibility of the display apparatus having the 4-pixel structure may be improved.

Figure 7:
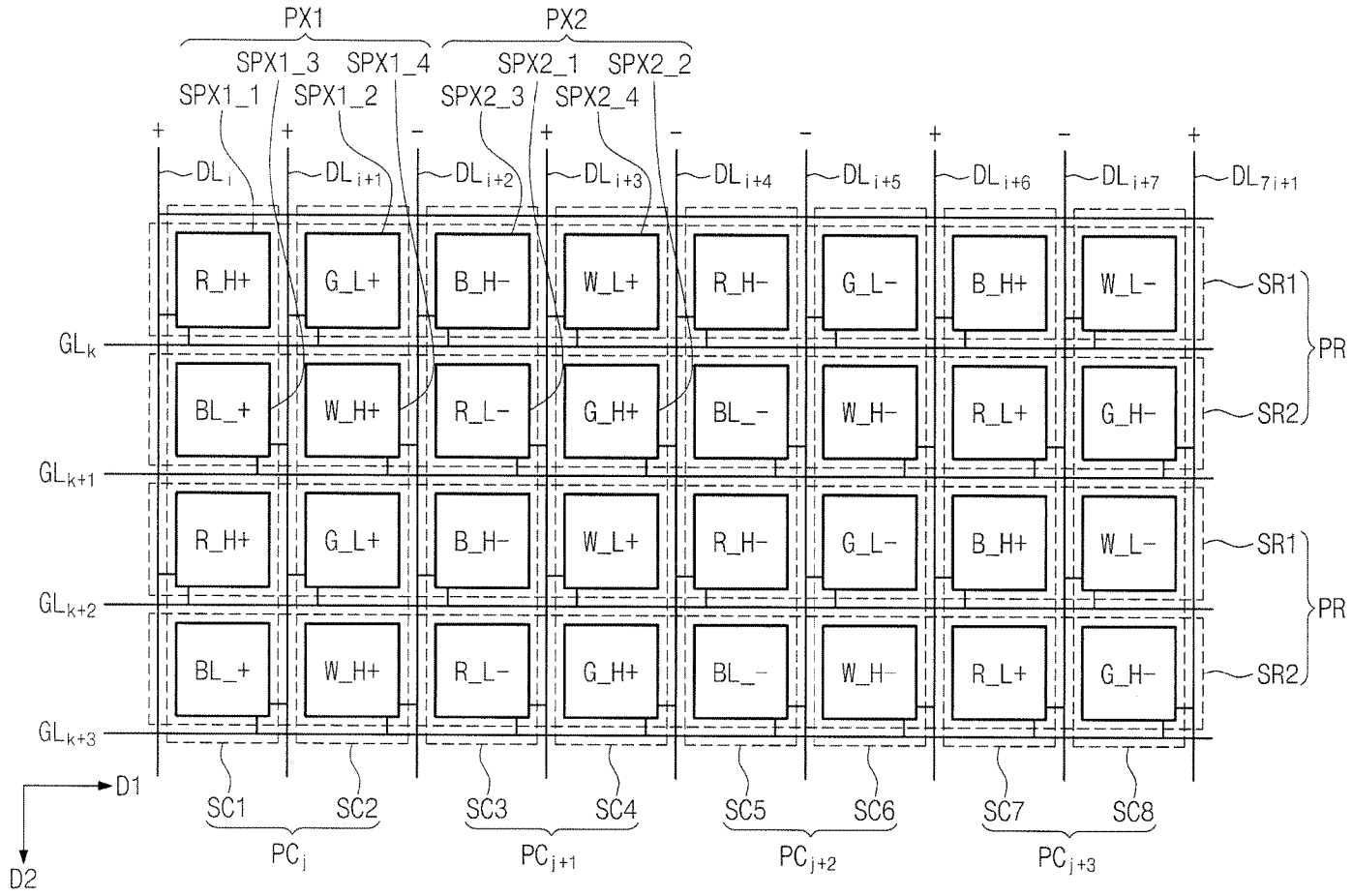
FIG. 7 illustrates another embodiment of pixel groups.

FIG. 7 illustrates another embodiment of a pixel groups of a display apparatus, which includes a plurality of gate lines $GL_k$ to $GL_{k+3}$ extending in the first direction D1 and a plurality of data lines $DL_i$ to $DL_{i+7}$ extending in the second direction D2. For illustrative purposes only, eight data lines $DL_i$ to $DL_{i+7}$ and four gate lines $GL_k$ to $GL_{k+3}$ are shown in FIG. 7, with the understanding that the number of the gate lines and the number of the data lines may be different in another embodiment. FIG. 7 shows two pixel rows among the pixel rows and four pixel columns $PC_j$ to $PC_{j+3}$ among the pixel columns.

Among the four pixel columns $PC_j$ to $PC_{j+3}$, the j-th pixel column $PC_j$ includes the first and second sub-pixel columns SC1 and SC2. Among the pixels arranged in the first sub-pixel column SC1, the pixels arranged in the first sub-pixel row SR1 (e.g., the first red pixel SPX1_1) are connected to the i-th data line $DL_i$, and the pixels arranged in the second sub-pixel row SR2 (e.g., the first blue pixel SPX1_3) are connected to the (i+1)th data line $DL_{i+1}$. In addition, among the pixels arranged in the second sub-pixel column SC2, the pixels arranged in the first sub-pixel row SR1 (e.g., the first green pixel SPX1_2) are connected to the (i+1)th data line $DL_{i+1}$, and the pixels arranged in the second sub-pixel row SR2 (e.g., the first white pixel SPX1_4) are connected to the (i+2)th data line $DL_{i+2}$.

The (j+1)th pixel column $PC_{j+1}$ includes the third and fourth sub-pixel columns SC3 and SC4. Among the pixels arranged in the third sub-pixel column SC3, the pixels arranged in the first sub-pixel row SR1 (e.g., the second blue pixel SPX2_3) are connected to the (i+2)th data line $DL_{i+2}$, and the pixels arranged in the second sub-pixel row SR2 (e.g., the second red pixel SPX2_1) are connected to the (i+3)th data line $DL_{i+3}$. In addition, among the pixels arranged in the fourth sub-pixel column SC4, the pixels arranged in the first sub-pixel row SR1 (e.g., the second white pixel SPX2_4) are connected to the (i+3)th data line $DL_{i+3}$, and the pixels arranged in the second sub-pixel row SR2 (e.g., the second green pixel SPX2_2) are connected to the (i+4)th data line $DL_{i+4}$.

The (j+2)th pixel column $PC_{j+2}$ includes the fifth and sixth sub-pixel columns SC5 and SC6. Among the pixels arranged in the fifth sub-pixel column SC5, the pixels arranged in the first sub-pixel row SR1 (e.g., the first red pixel SPX1_1) are connected to the (i+4)th data line $DL_{i+4}$, and the pixels arranged in the second sub-pixel row SR2 (e.g., the first blue pixel SPX1_3) are connected to the (i+5)th data line $DL_{i+5}$. In addition, among the pixels arranged in the sixth sub-pixel column SC6, the pixels arranged in the first sub-pixel row SR1 (e.g., the first green pixel SPX1_2) are connected to the (i+5)th data line $DL_{i+5}$, and the pixels arranged in the second sub-pixel row SR2 (e.g., the first white pixel SPX1_4) are connected to the (i+6)th data line $DL_{i+6}$.

The (j+3)th pixel column $PC_{j+3}$ includes the seventh and eighth sub-pixel columns SC7 and SC8. Among the pixels arranged in the seventh sub-pixel column SC7, the pixels arranged in the first sub-pixel row SR1 (e.g., the second blue pixel SPX2_3) are connected to the (i+6)th data line $DL_{i+6}$, and the pixels arranged in the second sub-pixel row SR2 (e.g., the second red pixel SPX2_1) are connected to the (i+7)th data line $DL_{i+7}$. In addition, among the pixels arranged in the eighth sub-pixel column SC8, the pixels arranged in the first sub-pixel row SR1 (e.g., the second white pixel SPX2_4) are connected to the (i+7)th data line $DL_{i+7}$, and the pixels arranged in the second sub-pixel row SR2 (e.g., the second green pixel SPX2_2) are connected to the (7i+1)th data line $DL_{7i+1}$.

In FIG. 7, the pixel structure is substantially the same as that of the pixel structure shown in FIG. 6, except that the pixels arranged in the first sub-pixel row SR1 among the pixels arranged in the same sub-pixel column are connected to the left data line and the pixels arranged in the second sub-pixel row SR2 are connected to the right data line among the pixels arranged in the same sub-pixel column.

As an example of the present disclosure, the positive (+) data voltage is applied to the i-th, (i+1)th, and (i+3)th data lines $DL_i$, $DL_{i+1}$, and $DL_{i+3}$ and the negative (−) data voltage is applied to the (i+2)th data line $DL_{i+2}$. The polarity of the data voltage applied to the data lines $DL_i$ to $DL_{i+7}$ is inverted every four data lines. For instance, the i-th to (i+3)th data lines $DL_i$ to $DL_{i+3}$ are respectively applied with the data voltages having +, +, −, and + polarities, and the (i+4)th to (i+7)th data lines $DL_{i+4}$ to $DL_{i+7}$ are respectively applied with the data voltages having −, −, +, and − polarities.

The first red pixels SPX1_1 applied with the red high voltage R_H are arranged in the first sub-pixel row SR1 and the second red pixels SPX2_1 applied with the red low voltage R_L are arranged in the second sub-pixel row SR2. The number of the first red pixels SPX1_1 having the positive polarity among the first red pixels SPX1_1 in the first sub-pixel row SR1 is equal to the number of the first red pixels SPX1_1 having the negative polarity among the first red pixels SPX1_1 in the first sub-pixel row SR1. Similar to the red pixels, among the pixels having the same color in the first sub-pixel row SR1, the number of the pixels having the positive polarity is equal to the number of the pixels having the negative polarity.

In addition, the number of the second red pixels SPX2_1 having the positive polarity among the second red pixels SPX2_1 in the second sub-pixel row SR2 is equal to the number of the second red pixels SPX2_1 having the negative polarity among the second red pixels SPX2_1 in the second sub-pixel row SR2. Similar to the red pixels, among the pixels having the same color in the second sub-pixel row SR2, the number of the pixels having the positive polarity is equal to the number of the pixels having the negative polarity.

As described above, when the number of the pixels having the positive polarity is equal to the number of the pixels having the negative polarity among the pixels having the same color in one sub-pixel row, a sum of polarities of the pixel voltages applied to the pixels while the one sub-pixel row is driven becomes zero (0), and thus the common voltage is prevented from shifting to a specific polarity.

Figure 8:
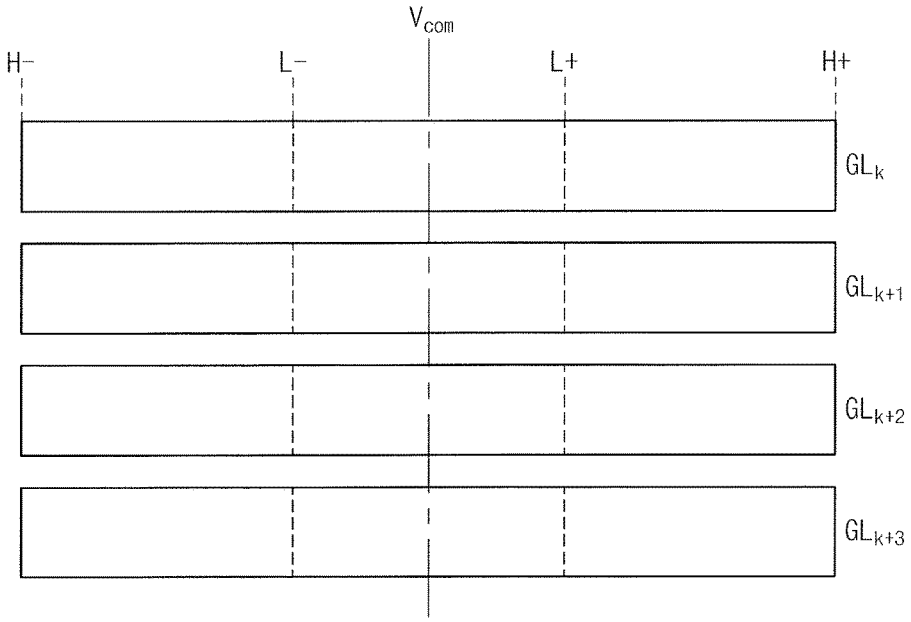
FIG. 8 illustrates an example of a ripple offset structure.

FIG. 8 illustrates an example of a ripple offset structure of a common voltage in the unit of pixel row in FIGS. 6 and 7. Referring to FIG. 8, among the pixels having the same color in one sub-pixel row, the number of the pixels applied with the positive high gray-scale voltage H+ is equal to the number of the pixels applied with the negative high gray-scale voltage H−. In addition, among the pixels having the same color in one sub-pixel row, the number of the pixels applied with the positive low gray-scale voltage L+ is equal to the number of the pixels applied with the negative low gray-scale voltage L−.

Accordingly, a sum of the positive high gray-scale voltages H+ and the negative high gray-scale voltages H−, which are applied to the pixels during each scanning period in which the k-th to (k+1)th gate lines $GL_k$ to $BL_{k+1}$, becomes zero (0) and a sum of the positive low gray-scale voltages L+ and the negative low gray-scale voltages L−, which are applied to the pixels during each scanning period in which the k-th to (k+1)th gate lines $GL_k$ to $BL_{k+1}$, becomes zero (0). Therefore, the reference voltage used to determine the positive and negative polarities is prevented from shifting to the specific polarity in each scanning period and maintains a reference level, e.g., 0 volts.

When the common voltage Vcom is shifted to the specific polarity, the difference in brightness occurs between the positive-polarity pixel and the negative-polarity pixel. As described above, in the 4-pixel structure, when the number of the positive-polarity pixels is equal to the number of the negative-polarity pixels among the pixels having the same color in one sub-pixel row, the brightness difference caused by the shift of the common voltage may be prevented.

In FIGS. 6 and 7, the i-th to (i+3)th data lines $DL_i$ to $DL_{i+3}$ are respectively applied with the data voltages having +, +, −, and + polarities, and the (i+4)th to (i+7)th data lines $DL_{i+4}$ to $DL_{i+7}$ are respectively applied with the data voltages having −, −, +, and − polarities. However, the polarities of the data voltages applied to the i-th to (i+7)th data lines $DL_i$ to $DL_{i+7}$ may be changed as long as the number of the positive pixels is equal to the number of the negative pixels among the pixels having the same color in the one sub-pixel row.

Figure 9:
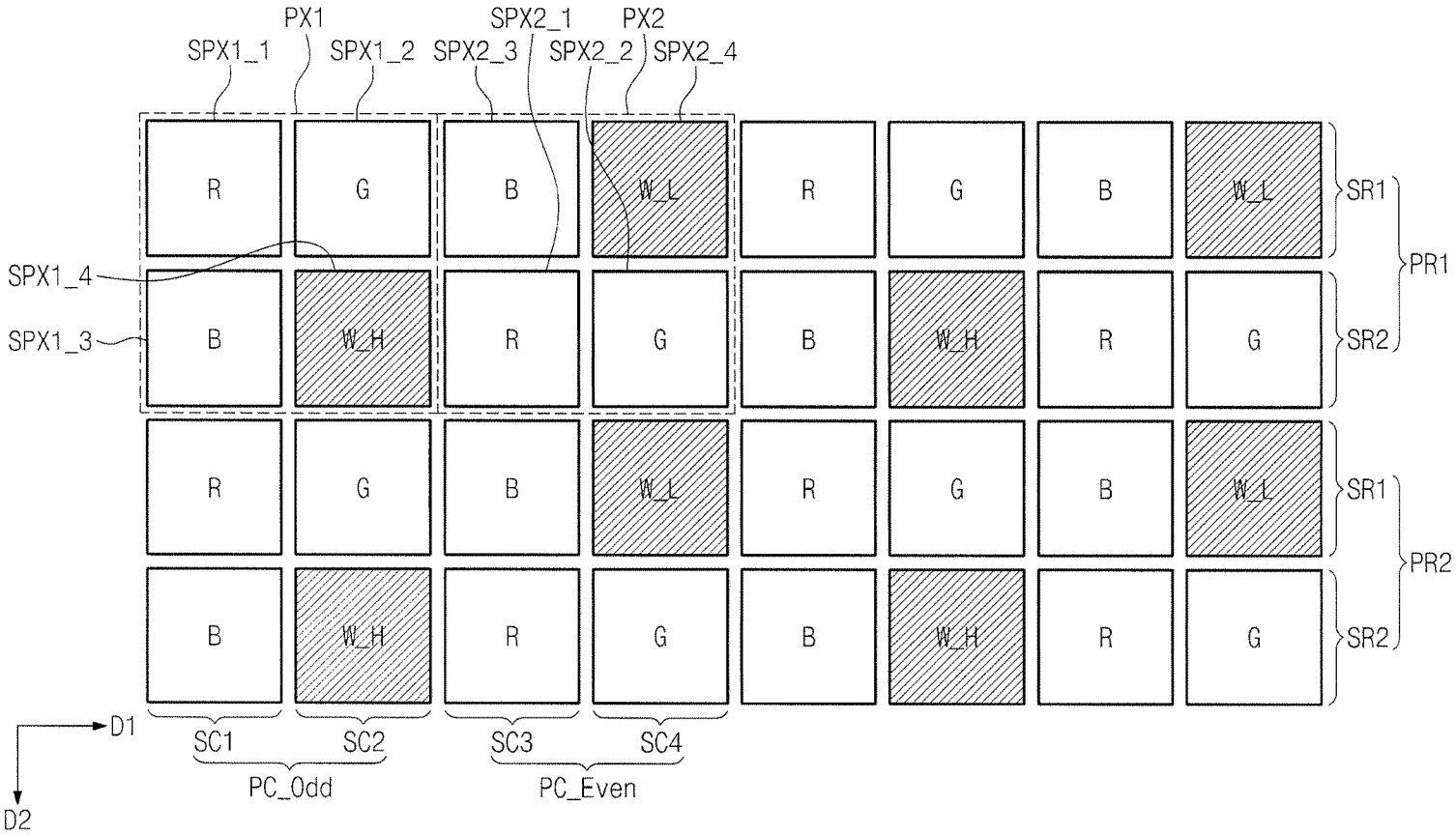
FIG. 9 illustrates another embodiment of a pixel arrangement.

FIG. 9 illustrates another embodiment of a pixel arrangement of a display apparatus which includes a plurality of pixel groups. The first pixel group PX1 includes a first red pixel SPX1_1, a first green pixel SPX1_2, a first blue pixel SPX1_3, and a first white pixel SPX1_4. The second pixel group PX2 includes a second red pixel SPX2_1, a second green pixel SPX2_2, a second blue pixel SPX2_3, and a second white pixel SPX2_4. A plurality of the first and second pixel groups PX1 and PX2 may be provided in each of the pixel rows PR1 and PR2. The first and second pixel groups PX1 and PX2 are alternately arranged with each other in each of the pixel rows PR1 and PR2. For example, the second pixel group PX2 is disposed right adjacent to the first pixel group PX1 in the first direction D1.

Each of the pixel rows PR1 and PR2 includes first and second sub-pixel rows SR1 and SR2. The first red pixel SPX1_1 and the first green pixel SPX1_2 of the first pixel group PX1 are arranged in the first sub-pixel row SR1, and the first blue pixel SPX1_3 and the first white pixel SPX1_4 of the first pixel group PX1 are arranged in the second sub-pixel row SR2. On the contrary, the second blue pixel SPX2_3 and the second white pixel SPX2_4 of the second pixel group PX2 are arranged in the first sub-pixel row SR1 and the second red pixel SPX2_1 and the second green pixel SPX2_2 of the second pixel group PX2 are arranged in the second sub-pixel row SR2.

Accordingly, as viewed relative to each of the pixel rows PR1 and PR2, the first white pixel SPX1_4 and the second white pixel SPX2_4 are alternately arranged along the first direction D1.

In the odd-numbered pixel row PR1 of the pixel rows PR1 and PR2, the first white pixel SPX1_4 is applied with the white high voltage W_H generated on the basis of the first gamma curve G1 (refer to FIG. 3) and the second white pixel SPX2_4 is applied with the white low voltage W_L generated on the basis of the second gamma curve G2 (refer to FIG. 3).

In the even-numbered pixel row PR2 of the pixel rows PR1 and PR2, the first white pixel SPX1_4 is applied with the white low voltage W_L generated on the basis of the second gamma curve G2 (refer to FIG. 3) and the second white pixel SPX2_4 is applied with the white high voltage W_H generated on the basis of the first gamma curve G1 (refer to FIG. 3).

Therefore, in each of the pixel rows PR1 and PR2, the pixels applied with the white high voltage W_H are alternately arranged with the pixels applied with the white low voltage W_L in the first direction D1. For example, the pixels applied with the white low voltage W_L are arranged only in the first sub-pixel row SR1 of each of the pixel rows PR1 and PR2, and the pixels applied with the white high voltage W_H are arranged only in the second sub-pixel row SR2 of each of the pixel rows PR1 and PR2.

In addition, the pixels applied with the white high voltage W_H are arranged in even-numbered sub-pixel columns SC2 among odd-numbered pixel columns PC_Odd, and the pixels applied with the white low voltage W_L are arranged in even-numbered sub-pixel columns SC4 among even-numbered pixel columns PC_Even.

In another embodiment, the arrangement of pixels may be different as long as the pixels applied with the white high voltage W_H and the pixels applied with the white low voltage W_L are alternately arranged in the first direction D1 or the second direction D2.

Figure 10:
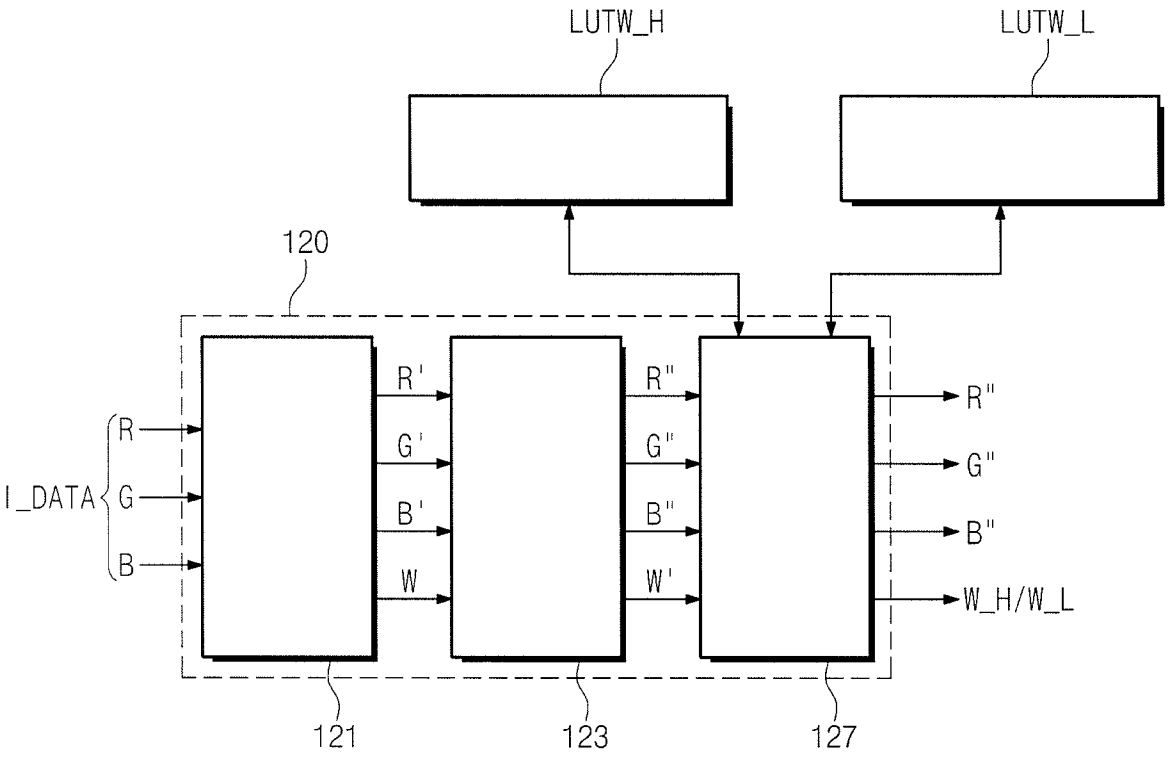
FIG. 10 illustrates another embodiment of a timing controller.

FIG. 10 illustrates another embodiment of a timing controller 120 and a look-up table. Referring to FIG. 10, the timing controller 120 includes a gamma mapping part 121, a rendering part 123, and a gamma converting part 127. The gamma mapping part 121 and the rendering part 123 may correspond to those in FIG. 5.

The gamma converting part 127 converts the white pixel data W' to data having two gamma characteristics with reference to first and second white look-up tables LUTW_H and LUTW_L.

The first white look-up table LUTW_H stores first sampling data, which are used such that the white pixel data W' is converted to have the brightness corresponding to the first gamma curve G1. The second white look-up table LUTW_L stores second sampling data, which are used such that the white pixel data W' is converted to have the brightness corresponding to the second gamma curve G2. The gamma converting part 127 converts the white pixel data W' to a white high data W_H and a white low data W_L with reference to the first and second white look-up tables LUTW_H and LUTW_L.

The white high data W_H and the white low data W_L, which are converted by the gamma converting part 127, are applied to the data driver 160. The data driver 160 converts the white high data W_H and the white low data W_L to an analog white high data W_H and an analog white low data W_L, and then applies the analog white high voltage and the analog white low voltage to the white pixels, respectively.

The gamma converting part 127 applies the red, green, and blue image data R', G', and B' to the data driver 160 (refer to FIG. 2) without performing the conversion process on the red, green, and blue image data R', G', and B', which is based on the first and second gamma curves G1 and G2.

Figure 11:
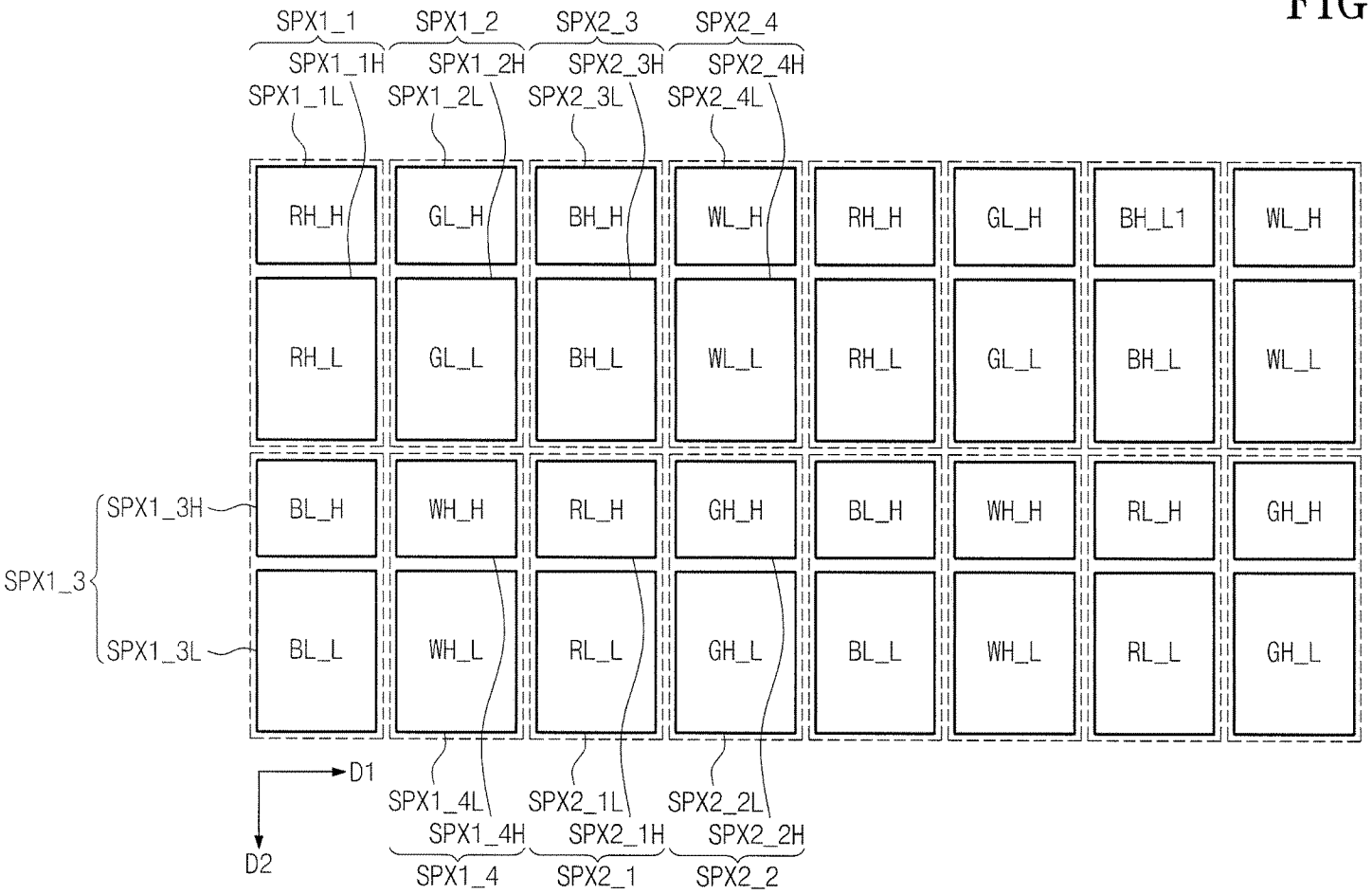
FIG. 11 illustrates another embodiment of a pixel arrangement.
Figure 12A:
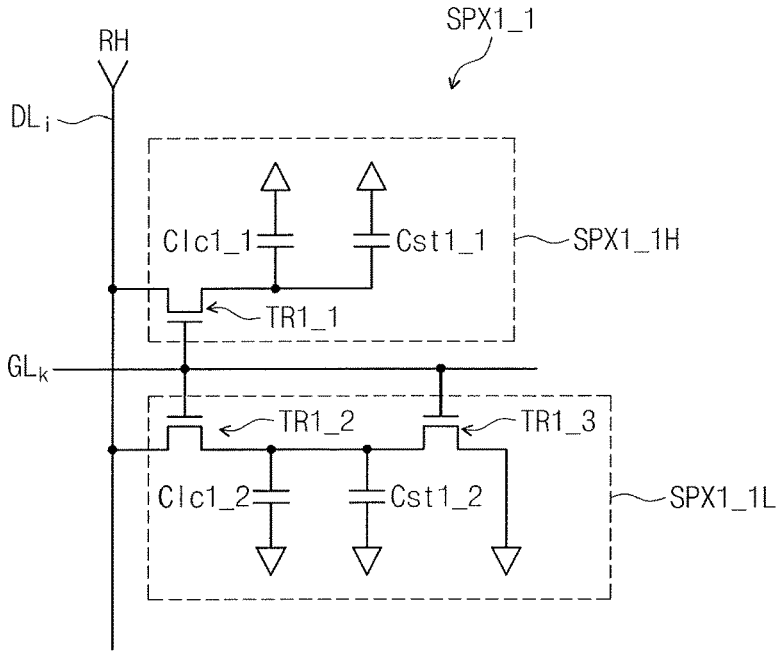
FIGS. 12A and 12B illustrate embodiments of a first and second red pixels.
Figure 12B:
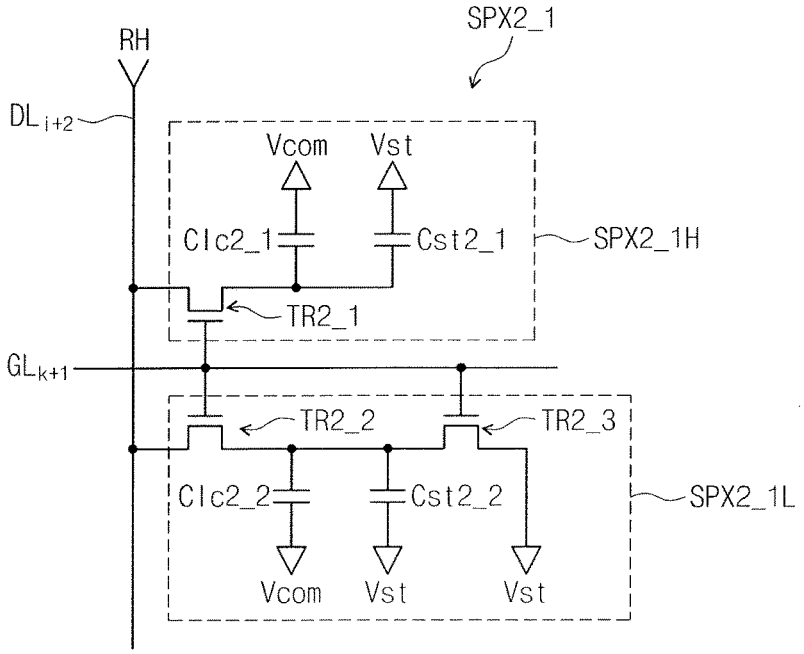

FIG. 11 illustrates another embodiment of a pixel arrangement of a display apparatus. FIG. 12A is an equivalent circuit diagram of one embodiment of a first red pixel in FIG. 11. FIG. 12B is an equivalent circuit diagram of one embodiment of a second red pixel shown in FIG. 11.

Referring to FIG. 11, a first pixel group PX1 includes first red, first green, first blue, and first white pixels SPX1_1, SPX1_2, SPX1_3, and SPX1_4. A second pixel group PX2 includes second red, second green, second blue, and second white pixels SPX2_1, SPX2_2, SPX2_3, and SPX2_4. The first and second pixel groups PX1 and PX2 are alternately arranged in the first direction D1.

The first red pixel SPX1_1 includes a first red high pixel SPX1_1H and a first red low pixel SPX1_1L and the first green pixel SPX1_2 includes a first green high pixel SPX1_2H and a first green low pixel SPX1_2L. The first blue pixel SPX1_3 includes a first blue high pixel SPX1_3H and a first blue low pixel SPX1_3L and the first white pixel SPX1_4 includes a first white high pixel SPX1_4H and a first white low pixel SPX1_4L. The first red pixel SPX1_1 and the first white pixel SPX1_4 are respectively applied with a first red pixel voltage RH and a first white pixel voltage WH, which are based on the first gamma curve G1 (refer to FIG. 3). The first green pixel SPX1_2 and the first blue pixel SPX1_3 are respectively applied with a first green pixel voltage GL and a first blue pixel voltage BL, which are based on the second gamma curve G2 (refer to FIG. 3).

The first red high pixel SPX1_1H of the first red pixel SPX1_1 receives the first red pixel voltage RH as the first red high voltage RH_H to display an image. The first red low pixel SPX1_1L of the first red pixel SPX1_1 converts the first red pixel voltage RH to the first red low voltage RH_L having a gray-scale lower than that of the first red pixel voltage RH to display the image. The first white high pixel SPX1_4H of the first white pixel SPX1_4 receives the first white pixel voltage WH as the first white high voltage WH_H to display the image. The first white low pixel SPX1_4L of the first white pixel SPX1_4 converts the first white pixel voltage WH to the first white low voltage WH_L having a gray-scale lower than that of the first white pixel voltage WH to display the image.

The first green high pixel SPX1_2H of the first green pixel SPX1_2 receives the first green pixel voltage GL as the first green high voltage GL_H to display an image. The first green low pixel SPX1_2L of the first green pixel SPX1_2 converts the first green pixel voltage GL to the first green low voltage GL_L having a gray-scale lower than that of the first green pixel voltage GL to display the image. The first blue high pixel SPX1_3H of the first blue pixel SPX1_3 receives the first blue pixel voltage BL as the first blue high voltage BL_H to display an image. The first blue low pixel SPX1_3L of the first blue pixel SPX1_3 converts the first blue pixel voltage BL to the first blue low voltage BL_L having a gray-scale lower than that of the first blue pixel voltage BL to display the image.

The second red pixel SPX2_1 includes a second red high pixel SPX2_1H and a second red low pixel SPX2_1L and the second green pixel SPX2_2 includes a second green high pixel SPX2_2H and a second green low pixel SPX2_2L. The second blue pixel SPX2_3 includes a second blue high pixel SPX2_3H and a second blue low pixel SPX2_3L and the second white pixel SPX2_4 includes a second white high pixel SPX2_4H and a second white low pixel SPX2_4L. The second red pixel SPX2_1 and the second white pixel SPX2_4 are respectively applied with a second red pixel voltage RL and a second white pixel voltage WL, which are based on the second gamma curve G2 (refer to FIG. 3). The second green pixel SPX2_2 and the second blue pixel SPX2_3 are respectively applied with a second green pixel voltage GH and a second blue pixel voltage BH, which are based on the first gamma curve G1 (refer to FIG. 3).

The second red high pixel SPX2_1H of the second red pixel SPX2_1 receives the second red pixel voltage RL as the second red high voltage RL_H to display an image. The second red low pixel SPX2_1L of the second red pixel SPX2_1 converts the second red pixel voltage RL to the second red low voltage RL_L having a gray-scale lower than that of the second red pixel voltage RL to display the image. The second white high pixel SPX2_4H of the second white pixel SPX2_4 receives the second white pixel voltage WL as the second white high voltage WL_H to display the image. The second white low pixel SPX2_4L of the second white pixel SPX2_4 converts the second white pixel voltage WL to the second white low voltage WL_L having a gray-scale lower than that of the second white pixel voltage WL to display the image.

The second green high pixel SPX2_2H of the second green pixel SPX2_2 receives the second green pixel voltage GH as the second green high voltage GH_H to display an image. The second green low pixel SPX2_2L of the second green pixel SPX2_2 converts the second green pixel voltage GH to the second green low voltage GH_L having a gray-scale lower than that of the second green pixel voltage GH to display the image. The second blue high pixel SPX2_3H of the second blue pixel SPX2_3 receives the second blue pixel voltage BH as the second blue high voltage BH_H to display an image. The second blue low pixel SPX2_3L of the second blue pixel SPX2_3 converts the second blue pixel voltage BH to the second blue low voltage BH_L having a gray-scale lower than that of the second blue pixel voltage BH to display the image.

Referring to FIG. 12A, the first red high pixel SPX1_1H of the first red pixel SPX1_1 includes a first thin film transistor TR1_1, a first liquid crystal capacitor Clc1_1, and a first storage capacitor Cst1_1, and the first red low pixel SPX1_1L of the first red pixel SPX1_1 includes a second thin film transistor TR1_2, a second liquid crystal capacitor Clc1_2, a second storage capacitor Cst1_2, and a third thin film transistor TR1_3.

The first thin film transistor TR1_1 includes a first gate electrode connected to the k-th gate line $GL_k$, a first source electrode connected to the i-th data line $DL_i$, and a first drain electrode connected to the first liquid crystal capacitor Clc1_1 and the first storage capacitor Cst1_1.

The first liquid crystal capacitor Clc1_1 includes a first electrode connected to the first drain electrode of the first thin film transistor TR1_1 and a second electrode applied with the common voltage Vcom. The first storage capacitor Cst1_1 includes a first electrode connected to the first drain electrode of the first thin film transistor TR1_1 and a second electrode applied with a storage voltage Vcst.

The second thin film transistor TR1_2 includes a second gate electrode connected to the k-th gate line $GL_k$, a second source electrode connected to the i-th data line $DL_i$, and a second drain electrode connected to the second liquid crystal capacitor Clc1_2 and the second storage capacitor Cst1_2.

The second liquid crystal capacitor Clc1_2 includes a first electrode connected to the second drain electrode of the second thin film transistor TR1_2 and a second electrode applied with the common voltage Vcom. The second storage capacitor Cst1_2 includes a first electrode connected to the second drain electrode of the second thin film transistor TR1_2 and a second electrode applied with storage voltage Vcst.

The third thin film transistor TR1_3 includes a third gate electrode connected to the k-th gate line $GL_k$, a third source electrode applied with the storage voltage Vcst, and a third drain electrode electrically connected to the second drain electrode of the second thin film transistor TR1_2.

The first to third thin film transistors TR1_1 to TR1_3 are turned on in response to the gate signal provided through the k-th gate line $GL_k$. The first red pixel voltage RH provided through the i-th data line DLi is applied to the first electrode of the first liquid crystal capacitor Clc1_1 through the turned-on first thin film transistor TR1_1. The first liquid crystal capacitor Clc1_1 is charged with the first red high voltage RH_H corresponding to a difference in level between the first red pixel voltage RH and the common voltage Vcom. The first red pixel voltage RH is applied to the first electrode of the second liquid crystal capacitor Clc1_2 through the turned-on second thin film transistor TR1_2. The first red high voltage RH_H has a positive or negative polarity with respect to the common voltage Vcom.

The common voltage Vcom may have substantially the same voltage as the storage voltage Vcst. The storage voltage Vcst is applied to the first electrode of the second liquid crystal capacitor Clc1_2 through the turned-on third thin film transistor TR1_3. A voltage (hereinafter, referred to as a divided voltage) at a contact node CN, to which the second drain electrode of the second thin film transistor TR1_2 and the third drain electrode of the third thin film transistor TR1_3 are connected, corresponds to a voltage divided by a resistance value when the second and third thin film transistors TR1_2 and TR1_3 are turned on. For example, the divided voltage has a value between the first red pixel voltage RH provided through the second thin film transistor TR1_2 and the storage voltage Vcst provided through the third thin film transistor TR1_3. Accordingly, the second liquid crystal capacitor Clc1_2 is charged with the first red low voltage RH_L corresponding to a difference in level between the divided voltage and the common voltage Vcom.

Since the first red high voltage RH_H charged in the first liquid crystal capacitor Clc1_1 has a level different from that of the first red low voltage RH_L charged in the second liquid crystal capacitor Clc1_1, the gray-scale level displayed by the first red high pixel SPX1_1H is different from the gray-scale level displayed by the first red low pixel SPX1_1L.

As described above, the first red pixel SPX1_1 has a visible pixel structure in which the first red pixel SPX1_1 is divided into two areas to display different gray-scale levels from each other. Therefore, the side visibility of the first red pixel SPX1_1 may be improved.

FIG. 12A shows only the equivalent circuit diagram of the first red pixel SPX1_1, but the first green pixel SPX1_2, the first blue pixel SPX1_3, and the first white pixel SPX1_4 may have the similar circuit configurations to that of the first red pixel SPX1_1. Thus, each of the first green, first blue, and first white pixels SPX1_2, SPX1_3, and SPX1_4 has the visible pixel structure as same as the first red pixel SPX1_1, so that the side visibility of the first pixel group PX1 may be entirely improved.

Referring to FIG. 12B, the second red high pixel SPX2_1H of the second red pixel SPX2_1 includes a fourth thin film transistor TR2_1, a third liquid crystal capacitor Clc2_1, and a third storage capacitor Cst2_1, and the second red low pixel SPX2_1L of the second red pixel SPX2_1 includes a fifth thin film transistor TR2_2, a fourth liquid crystal capacitor Clc2_2, a fourth storage capacitor Cst2_2, and a sixth thin film transistor TR2_3.

The equivalent circuit diagram of the second red pixel SPX2_1 is similar to that of the first red pixel SPX1_1.

However, the first red pixel voltage RH applied to the first red pixel SPX1_1 is generated on the basis of the first gamma curve G1, but the second red pixel voltage RL applied to the second red pixel SPX2_1 is generated on the basis of the second gamma curve G2.

The second red pixel SPX2_1 includes the second red high pixel SPX2_1H and the second red low pixel SPX2_1L. The second red high voltage RL_H charged in the third liquid crystal capacitor Clc2_1 of the second red high pixel SPX2_1H and the second red low voltage RL_L charged in the fourth liquid crystal capacitor Clc2_2 of the second red low pixel SPX2_1L have different levels from each other. Accordingly, the gray-scale level displayed by the second red high pixel SPX2_1H is different from the gray-scale level displayed by the second red low pixel SPX2_1L. The second red pixel SPX2_1 has the visible pixel structure in which the second red pixel SPX2_I is divided into two areas to display different gray-scale levels from each other. Therefore, the side visibility of the second red pixel SPX2_1 may be improved.

FIG. 12B shows only the equivalent circuit diagram of the second red pixel SPX2_1, but the second green pixel SPX2_2, the second blue pixel SPX2_3, and the second white pixel SPX2_4 may have the similar circuit configurations to that of the second red pixel SPX2_1. Thus, each of the second green, second blue, and second white pixels SPX2_2, SPX2_3, and SPX2_4 has the visible pixel structure as same as the second red pixel SPX2_1, so that the side visibility of the second pixel group PX2 may be entirely improved.

FIGS. 12A and 12B show the equivalent circuit of the resistance division type visible pixel. In another embodiment, the visible pixel may have a charge sharing type circuit configuration to decrease the voltage applied to the low pixel more than the voltage applied to the high pixel.

Figure 13:
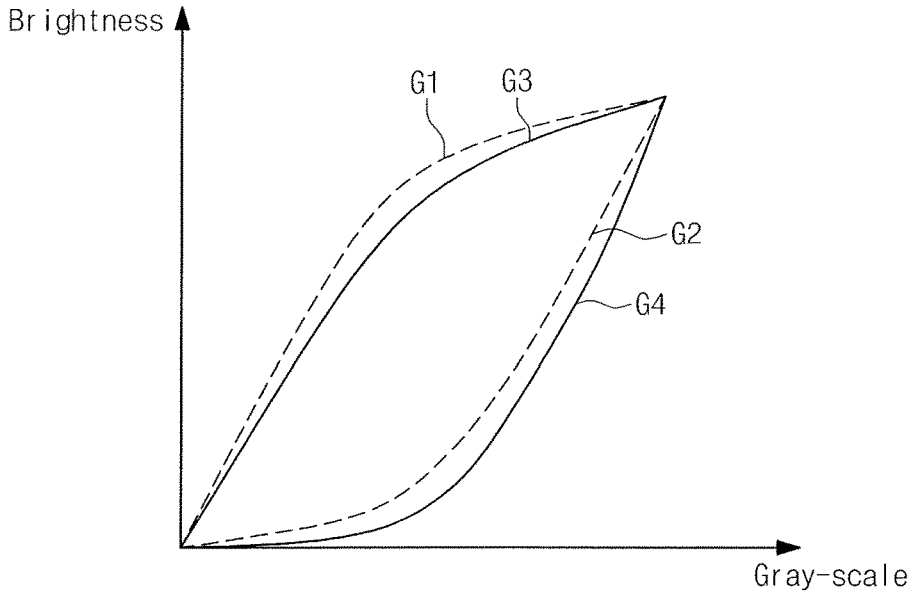
FIG. 13 illustrates an embodiment of gamma curves for the red pixels.

FIG. 13 is a graph illustrating examples of gamma curves for the first and second red pixels in FIG. 11. Referring to FIG. 13, the first gamma curve G1 includes brightness information used to generate the first red high voltage RH_H. The second gamma curve G2 includes brightness information used to generate the second red high voltage RL_H.

A third gamma curve G3 has a brightness value lower than that of the first gamma curve G1 with respect to the same gray-scale level. The first red low voltage RH_L is obtained by gray scale-converting the first red high voltage RH_H on the basis of the third gamma curve G3. A fourth gamma curve G4 has a brightness value lower than that of the second gamma curve G2 with respect to the same gray-scale level. The second red low voltage RL_L is obtained by gray scale-converting the first second red high voltage RL_H on the basis of the fourth gamma curve G4.

Referring to FIG. 11 again, as viewed relative to each pixel row PR, the first red pixel SPX1_1 and the second red pixel SPX2_1 are alternately arranged in the first direction D1. The first and second green pixels SPX1_2 and SPX2_2 are alternately arrange in the first direction D1 in each pixel row PR. The first and second blue pixels SPX1_3 and SPX2_3 are alternately arranged in the first direction D1 in each pixel row PR.

Accordingly, as viewed relative to the same color, the high pixel based on the first gamma curve G1 and the low pixel based on the second gamma curve G2 are spatially separately from each other in the first and second directions D1 and D2.

In addition, each of the high and low pixels is divided into a high gray-scale area having relatively high brightness and a low gray-scale area having relatively low brightness. Therefore, two pixels having the same color are divided into four gray-scale areas respectively corresponding to the first to fourth gamma curves G1 to G4 when the display apparatus is viewed in a plan view.

For example, as viewed relative to the white color, the first white pixel SPX1_4 based on the first gamma curve G1 and the second white pixel SPX2_4 based on the second gamma curve G2 are prepared and alternately arranged in the first direction D1 in each pixel row PR.

Further, each of the first and second white pixels SPX1_4 and SPX2_4 is divided into a high gray-scale area having relatively high brightness and a low gray-scale area having relatively low brightness. Thus, two pixels having the same color are divided into four gray-scale areas respectively corresponding to the first to fourth gamma curves G1 to G4 when the display apparatus is viewed in a plan view.

Accordingly, although the visible pixel structure in which each pixel is divided into two gray-scale areas is applied to the 4-pixel structure, the yellowish phenomenon at the side surface, which is caused by the white pixels, may be more improved compared with the pixel structure shown in FIG. 1.

Figure 14:
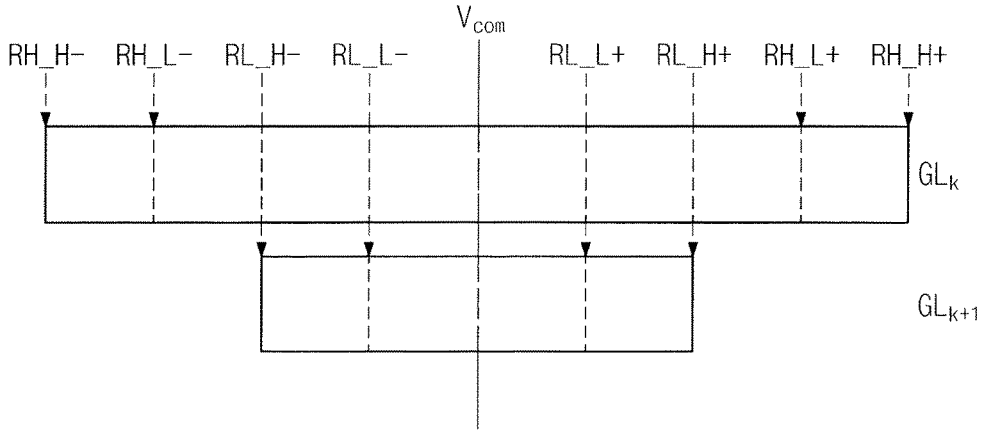
FIG. 14 illustrates an example of a ripple offset structure in FIG. 11.

FIG. 14 illustrates an example of a ripple offset structure of a common voltage in the unit of pixel row in FIG. 11. Referring to FIGS. 11 and 14, the number of the first red pixels SPX1_1 applied with the positive first red pixel voltage RH+ and arranged in the odd-numbered sub-pixel row connected to the k-th gate line $GL_k$ may be equal to the number of the first red pixels SPX1_1 applied with the negative first red pixel voltage RH− and arranged in the odd-numbered sub-pixel row connected to the k-th gate line $GL_k$. In addition, the positive first red pixel voltage RH+ is divided into a positive first red high voltage RH_H+ and a positive first red low voltage RH_L+ after being applied to the first red pixels SPX1_1. The negative first red pixel voltage RH− is divided into a negative first red high voltage RH_H− and a negative first red low voltage RH_L− after being applied to the first red pixels SPX1_1.

During a period in which the odd-numbered sub-pixel row is driven, a sum of the positive first red high voltage RH_H+ and the negative first red high voltage RH_H−, which are applied to the first red pixels, becomes zero (0). A sum of the positive first red low voltage RH_L+ and the negative first red low voltage RH_L−, which are applied to the first red pixels, becomes zero (0). The pixels having other colors may receive the voltages in a similar way.

The number of the second red pixels SPX2_1 applied with the positive second red pixel voltage RL+ and arranged in the even-numbered sub-pixel row connected to the (k+1)th gate line $GL_k$ may be equal to the number of the second red pixels SPX2_1 applied with the negative second red pixel voltage RL− and arranged in the even-numbered sub-pixel row connected to the (k+1)th gate line $GL_{k+1}$. In addition, the positive second red pixel voltage RL+ is divided into a positive second red high voltage RL_H+ and a positive second red low voltage RL_L+ after being applied to the second red pixels SPX2_1. The negative second red pixel voltage RL− is divided into a negative second red high voltage RL_H− and a negative second red low voltage RL_L− after being applied to the second red pixels SPX2_1.

During a period in which the even-numbered sub-pixel row is driven, a sum of the positive second red high voltage RL_H+ and the negative second red high voltage RL_H−, which are applied to the second red pixels, becomes zero (0). A sum of the positive second red low voltage RL_L+ and the negative second red low voltage RL_L−, which are applied to the second red pixels, becomes zero (0). The pixels having other colors may receive the voltages in a similar way.

Therefore, the common voltage Vcom used to determine the positive and negative polarities is prevented from shifting to the specific polarity in each scanning period and maintains a reference level, e.g., 0 volts.

When the common voltage Vcom is shifted to the specific polarity, the difference in brightness occurs between the positive-polarity pixel and the negative-polarity pixel. As described above, in the 4-pixel structure, when the number of the positive-polarity pixels is equal to the number of the negative-polarity pixels among the pixels having the same color in one sub-pixel row, the brightness difference caused by the shift of the common voltage may be prevented.

Figure 15:
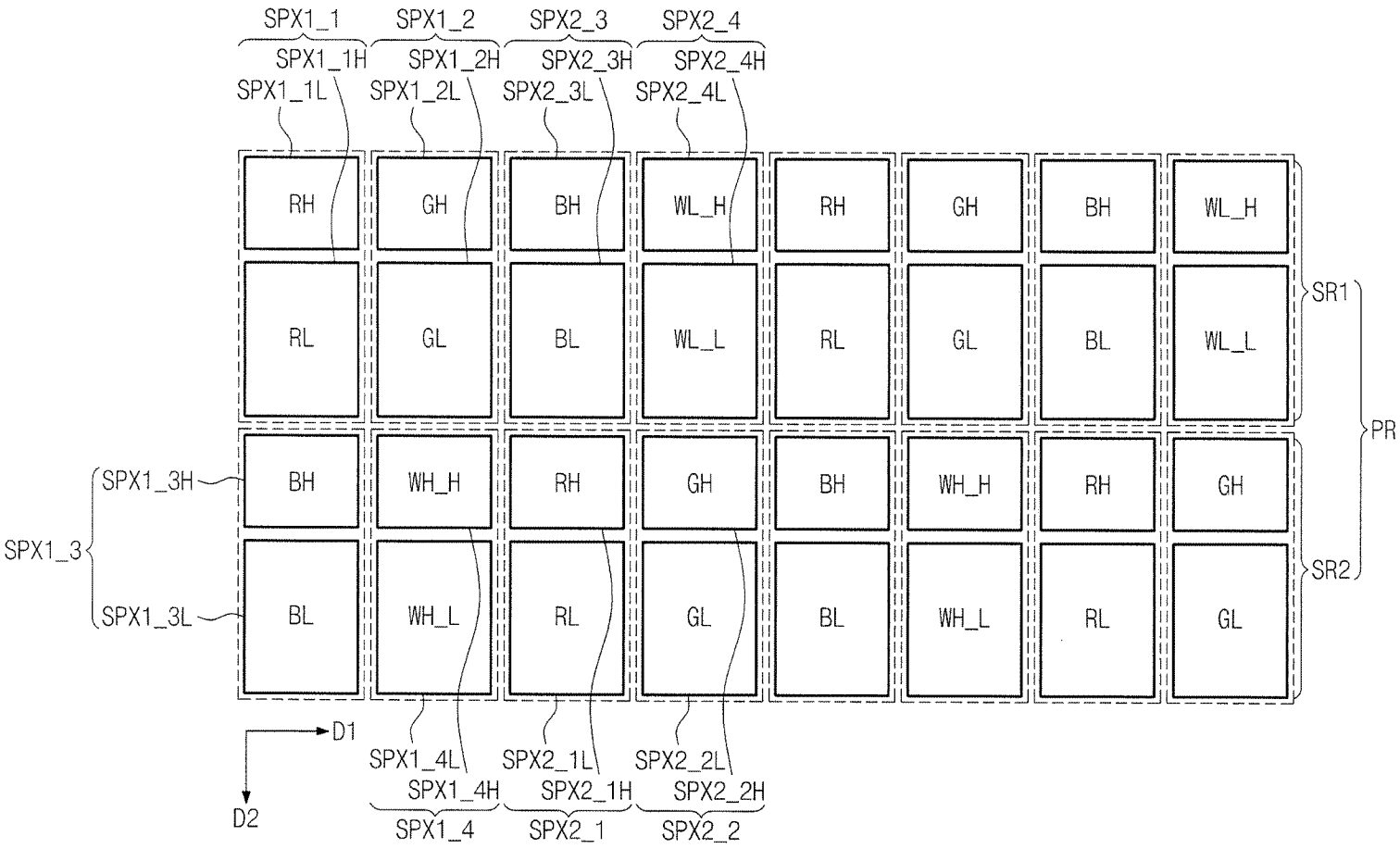
FIG. 15 illustrates another embodiment of a pixel arrangement.

FIG. 15 illustrates another embodiment of a pixel arrangement in a display apparatus having a visible pixel structure. Referring to FIG. 15, a first pixel group PX1 of the display apparatus includes first red, first green, first blue, and first white pixels SPX1_1, SPX1_2, SPX1_3, and SPX1_4. A second pixel group PX2 of the display apparatus includes second red, second green, second blue, and second white pixels SPX2_1, SPX2_2, SPX2_3, and SPX2_4. The first pixel group PX1 and the second pixel group PX2 are alternately arranged in the first direction D1. The structure of the first and second pixel groups PX1 and PX2 may be substantially the same as that of the first and second pixel groups shown in FIG. 10.

In FIG. 15, the first white pixel SPX1_4 of the first pixel group PX1 receives a first white pixel voltage WH on the basis of the first gamma curve G1 (refer to FIG. 3). The second white pixel SPX2_4 of the second pixel group PX2 receives a second white pixel voltage WL on the basis of the second gamma curve G2 (refer to FIG. 3).

Since the first and second white pixel voltages WH and WL are respectively converted on the basis of the first and second gamma curves G1 and G2, the first and second white pixel voltages have different voltage levels from each other with respect to the same gray-scale level. Accordingly, the first white pixel SPX1_4 may have transmittance higher than that of the second white pixel SPX2_4 with respect to the same gray-scale level.

Therefore, the first white pixels SPX1_4 applied with the first white pixel voltage WH are alternately arranged with the second white pixels SPX2_4 applied with the second white pixel voltage WL in each pixel row. For example, the second white pixels SPX2_4 applied with the second white pixel voltage WL are arranged only in the first sub-pixel row SR1 of each pixel row, and the first white pixels SPX1_4 applied with the first white pixel voltage WH are arranged only in the second sub-pixel row SR2 of each pixel row.

In addition, the first white pixels SPX1_4 applied with the first white pixel voltage WH are alternately arranged with the second white pixels SPX2_4 applied with the second white pixel voltage WL along the second direction D2 in two pixel columns adjacent to each other.

Meanwhile, the first white high pixel SPX1_4H of the first white pixel SPX1_4 receives the first white pixel voltage WH as a first white high voltage WH_H to display the image. The first white low pixel SPX1_4L of the first white pixel SPX1_4 converts the first white pixel voltage WH to a first white low voltage WH_L having a gray-scale level lower than that of the first white pixel voltage WH to display the image. The second white high pixel SPX2_4H of the second white pixel SPX2_4 receives the second white pixel voltage WL as a second white high voltage WL_H to display the image. The second white low pixel SPX2_4L of the second white pixel SPX2_4 converts the second white pixel voltage WL to a second white low voltage WL_L having a gray-scale level lower than that of the second white pixel voltage WL to display the image.

The 4-pixel structure, in which the white pixels having the white color are added to each pixel group, improves the whole brightness of the display apparatus, but the yellowish phenomenon may occur when viewed in the side surface. In this case, the white pixels having the white color may be operated as the first white pixel SPX1_4 based on the first gamma curve and the second white pixel SPX2_4 based on the second gamma curve, which are spatially separated from each other. Accordingly, the yellowish phenomenon may be prevented from occurring at the side surface and the whole side visibility of the display apparatus having the 4-pixel structure may be improved.

Meanwhile, the first red pixel SPX1_1 and the second red pixel SPX2_1 are applied with the red pixel voltage generated on the basis of the same gamma curve. The first and second red high pixels SPX1_1H and SPX2_1H receive the red pixel voltage as the red high voltage RH to display the image, and the first and second red low pixels SPX1_1L and SPX2_1L convert the red pixel voltage to the red low voltage RL having a gray-scale level lower than that of the red high voltage RH.

The first and second green pixel SPX1_2 and SPX2_2 receive the green pixel voltage generated on the basis of the same gamma curve and the first and second blue pixels SPX1_3 and SPX2_3 receive the blue pixel voltage generated on the basis of the same gamma curve.

In another embodiment, the pixels may be arranged in a different manner, as long as the pixels displaying the image using the first white high voltage WH_H and the first white low voltage WH_L are alternately arranged with the pixels displaying the image using the second white high voltage WL_H and the second white low voltage WL_L in the first direction D1 or the second direction D2.

Figure 16:
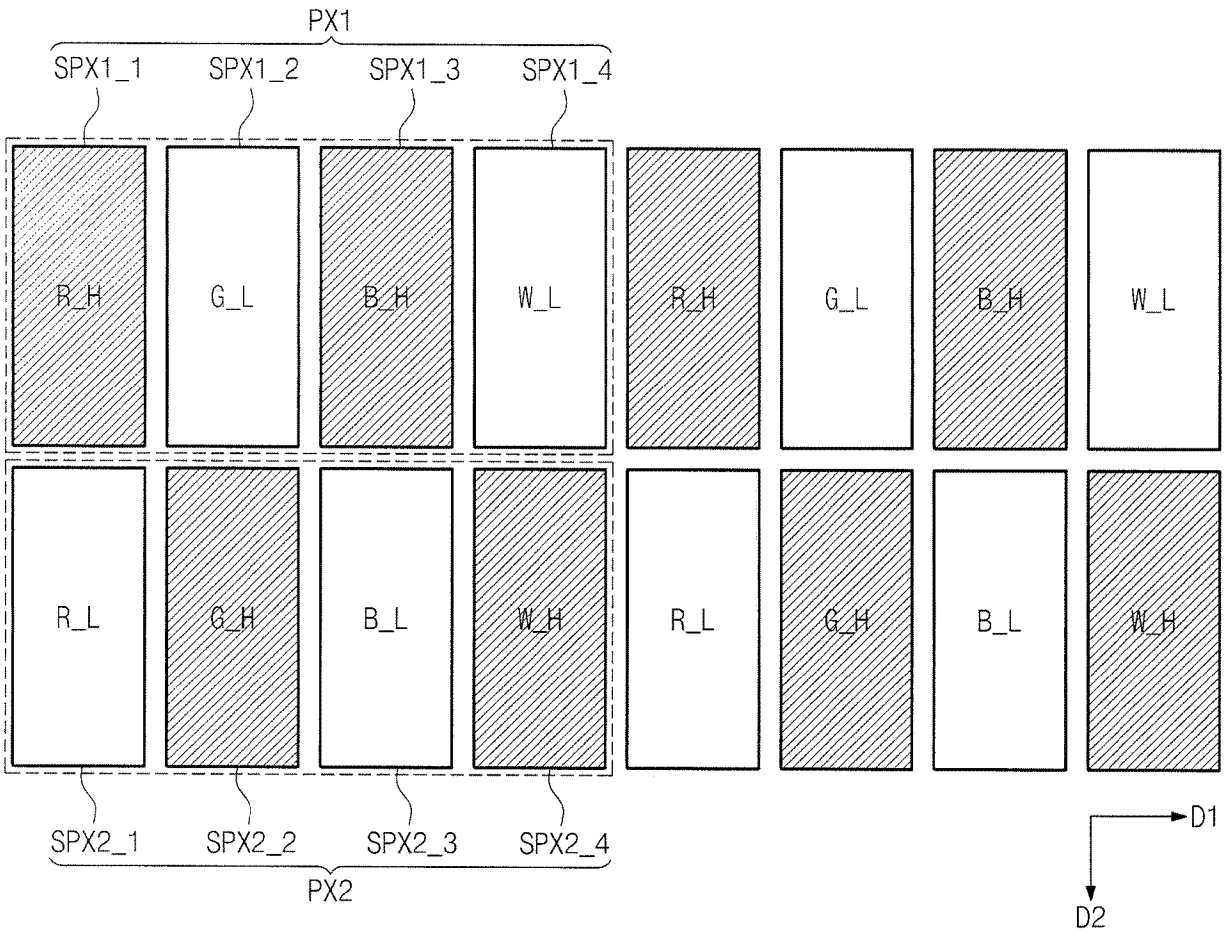
FIG. 16 illustrates another embodiment of a display apparatus.

FIG. 16 illustrates an embodiment of a display apparatus having a 4-pixel structure. Referring to FIG. 16, the display apparatus includes a plurality of pixel groups. The pixel groups are configured to include a first pixel group PX1 arranged along the first direction D1 in the odd-numbered pixel row and a second pixel group PX2 arranged along the first direction D1 in the even-numbered pixel row. The first pixel group PX1 includes first red, first green, first blue, and first white pixels SPX1_1, SPX1_2, SPX1_3, and SPX1_4, which are sequentially arranged in the first direction D1. The second pixel group PX2 includes second red, second green, second blue, and second white pixels SPX2_1, SPX2_2, SPX2_3, and SPX2_4, which are sequentially arranged in the first direction D1. The pixels having the same color may be disposed in the same sub-pixel column.

During a period in which the odd-numbered sub-pixel row is driven, the first red pixel SPX1_1 and the first blue pixel SPX1_3 respectively receive red and blue high voltages R_H and B_H generated on the basis of the first gamma curve G1 (refer to FIG. 3). The first green pixel SPX1_2 and the first white pixel SPX1_4 respectively receive green and white low voltages G_L and W_L generated on the basis of the second gamma curve G2 (refer to FIG. 3). During a period in which the even-numbered sub-pixel row is driven, the second red pixel SPX2_1 and the second blue pixel SPX2_3 respectively receive red and blue low voltages R_L and B_L generated on the basis of the second gamma curve G2. The second green pixel SPX2_2 and the second white pixel SPX2_4 respectively receive green and white high voltages G_H and W_H generated on the basis of the first gamma curve G1.

Accordingly, the pixel applied with the high voltage and the pixel applied with the low voltage may be alternately arranged with each other in each pixel row and in each pixel column.

As described above, since the pixels adjacent to each other in the first and second directions D1 and D2 are applied with data based on the different gamma curves G1 and G2, the side visibility of the display apparatus may be improved even though each pixel is not divided into two gray-scale areas.

Figure 17:
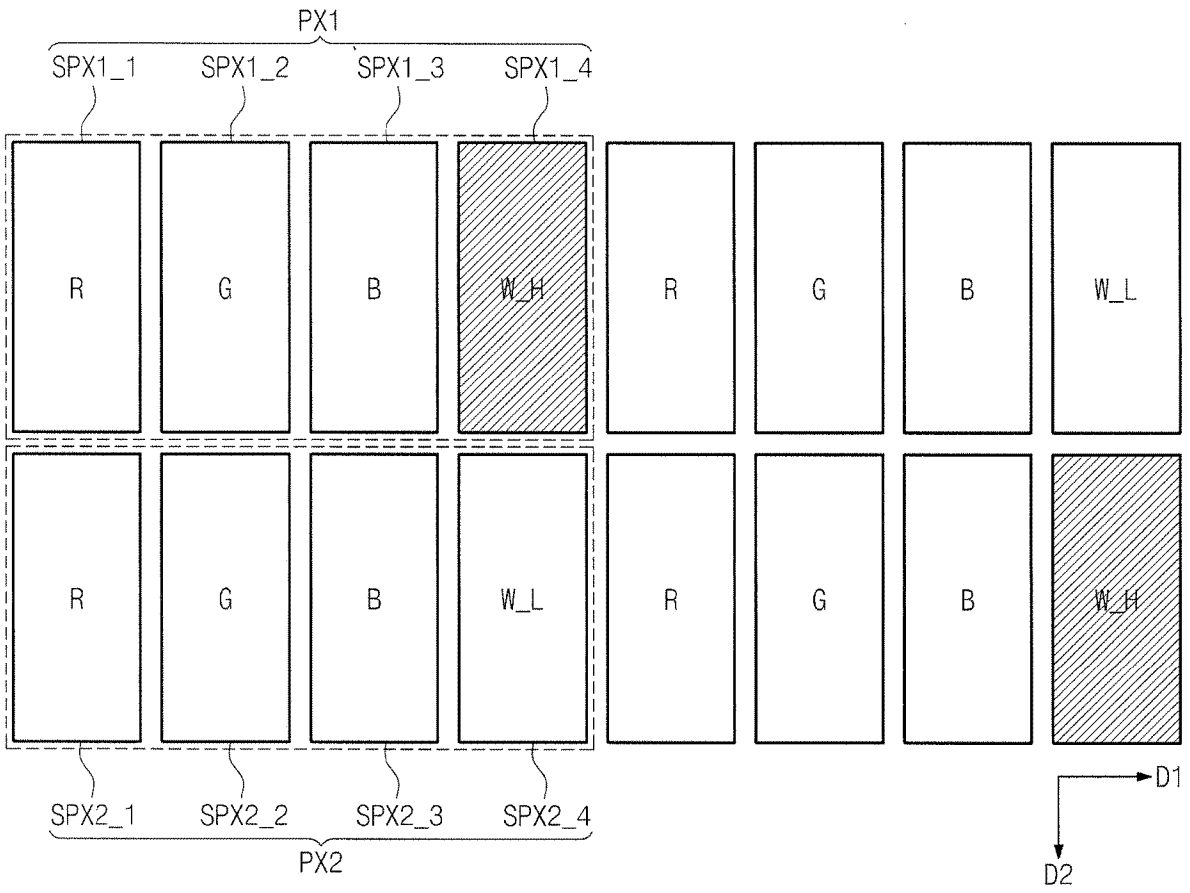
FIG. 17 illustrates another embodiment of a display apparatus.

FIG. 17 illustrates another embodiment of a display apparatus having a 4-pixel structure. Referring to FIG. 17, the display apparatus includes a plurality of pixel groups. The pixel groups include a first pixel group PX1 arranged along the first direction D1 in the odd-numbered pixel row and a second pixel group PX2 arranged along the first direction D1 in the even-numbered pixel row. The first pixel group PX1 includes first red, first green, first blue, and first white pixels SPX1_1, SPX1_2, SPX1_3, and SPX1_4, which are sequentially arranged in the first direction D1. The second pixel group PX2 includes second red, second green, second blue, and second white pixels SPX2_1, SPX2_2, SPX2_3, and SPX2_4, which are sequentially arranged in the first direction D1. The pixels having the same color may be disposed in the same sub-pixel column.

During a period in which the odd-numbered sub-pixel row is driven, the first white pixel SPX1_4 receives the white high voltage W_H. During a period in which the even-numbered sub-pixel row is driven, the second white pixel SPX2_4 receives the white low voltage W_L.

Therefore, the first white pixel SPX1_4 applied with the white high voltage W_H and the second white pixel SPX2_4 applied with the white low voltage W_L are alternately arranged with each other in each sub-pixel row. In addition, the first white pixel SPX1_4 applied with the white high voltage W_H and the second white pixel SPX2_4 applied with the white low voltage W_L are alternately arranged with each other in a 4n-th sub-pixel column.

As described above, since the first and second white pixels SPX1_4 and SPX2_4 adjacent to each other in the first and second directions D1 and D2 are applied with data based on the different gamma curves, the side visibility of the display apparatus may be improved even though each of the first and second white pixels SPX1_4 and SPX2_4 is not divided into two gray-scale areas.

Figure 18:
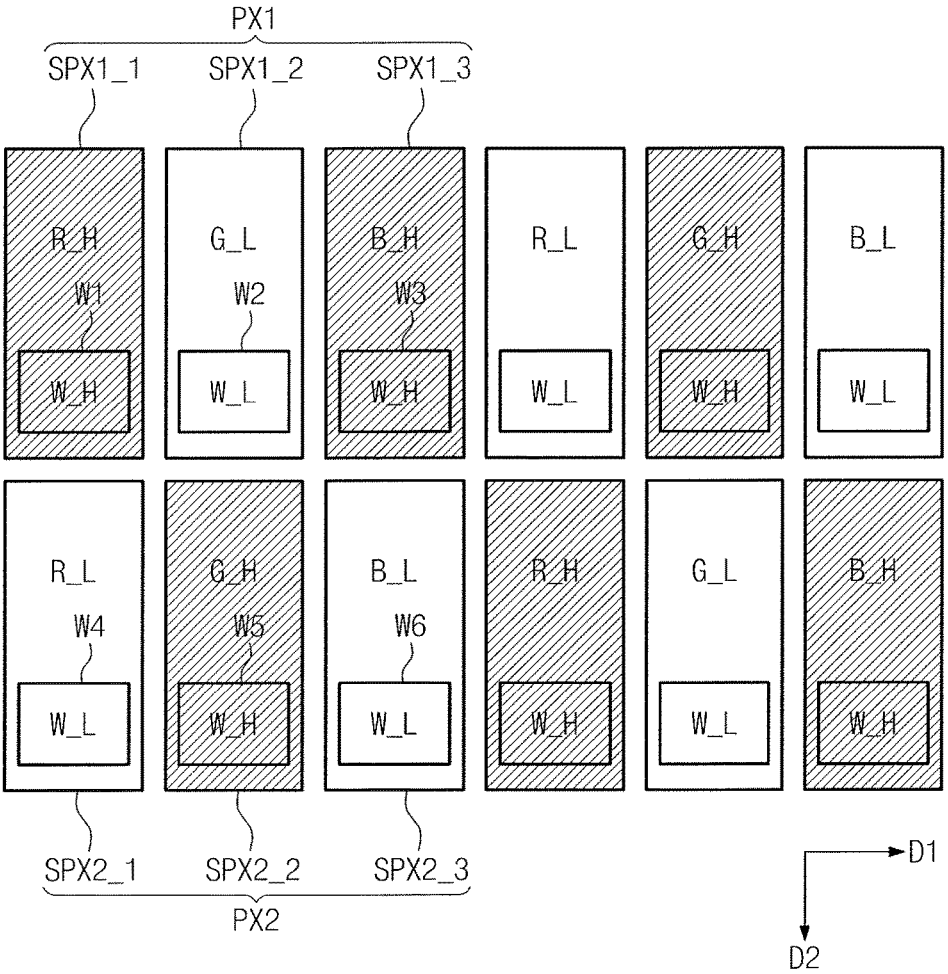
FIG. 18 illustrates another embodiment of a pixel structure.

FIG. 18 illustrates another pixel structure of a display apparatus, which includes first and second pixel groups PX1 and PX2 repeatedly arranged in the first and second directions D1 and D2.

The first pixel group PX1 includes first red, first green, and first blue pixels SPX1_1, SPX1_2, and SPX1_3, which are sequentially arranged in the first direction D1. The second pixel group PX2 includes second red, second green, and second blue pixels SPX2_1, SPX2_2, and SPX2_3, which are sequentially arranged in the first direction D1. The pixels having the same color may be disposed in the same sub-pixel column. The first red, first green, and first blue pixels SPX1_1, SPX1_2, and SPX1_3 respectively include red, green, and blue color filters, and the second red, second green, and second blue pixels SPX2_1, SPX2_2, and SPX2_3 include the red, green, and blue color filters, respectively.

At least one of the first red, first green, and first blue pixels SPX1_1, SPX1_2, and SPX1_3 includes a white area. In FIG. 18, the first red, first green, and first blue pixels SPX1_1, SPX1_2, and SPX1_3 include first, second, and third white areas W1, W2, and W3, respectively. The first to third white areas W1 to W3 may be defined by opening areas formed through the red, green, and blue color filters respectively disposed in the first red, first green, and first blue pixels SPX1_1, SPX1_2, and SPX1_3.

At least one of the second red, second green, and second blue pixels SPX2_1, SPX2_2, and SPX2_3 includes a white area. In FIG. 18, the second red, second green, and second blue pixels SPX2_1, SPX2_2, and SPX2_3 include fourth, fifth, and sixth white areas W4, W5, and W6, respectively. Although not shown in figures, the fourth to sixth white areas W4 to W6 may be defined by opening areas formed through the red, green, and blue color filters respectively disposed in the second red, second green, and second blue pixels SPX2_1, SPX2_2, and SPX2_3.

Accordingly, the pixel applied with the high voltage based on the first gamma curve G1 is alternately arranged with the pixel applied with the low voltage based on the second gamma curve G2 in each sub-pixel row. In addition, the high pixels applied with the high voltage are alternately arranged with the low pixels applied with the low voltage in each sub-pixel column.

As described above, since the pixels adjacent to each other in the first and second directions D1 and D2 are applied with data based on the different gamma curves, the side visibility of the display apparatus may be improved even though each pixel is not divided into two gray-scale areas.

Each of the first to third white areas W1 to W3 may have substantially the same gamma characteristics as that of the voltage applied to the corresponding pixel thereto. For example, when the first red pixel SPX1_1 receives the red high voltage R_H on the basis of the first gamma curve G1, the first white area W1 is operated by the white high voltage W_H having the same gamma characteristics as those of the first gamma curve G1. On the contrary, when the second red pixel SPX2_1 receives the red low voltage R_L on the basis of the second gamma curve G2, the fourth white area W4 is operated by the white low voltage W_L having the same gamma characteristics as that of the second gamma curve G2.

Therefore, when the first red, first green, and first blue pixels SPX1_1, SPX1_2, and SPX1_3 are operated to alternately have different gamma characteristics in the first direction D1, the first to third white areas W1 to W3 respectively disposed in the pixels alternately have different gamma characteristics in the first direction D1.

Although the white area is disposed in each pixel, two pixels may be operated to have different gamma characteristics from each other and the white areas may have different gamma characteristics in the unit of pixel. Thus, the yellowish phenomenon at the side surface in the structure in which the white area is disposed in each pixel may be prevented.

Figure 19:
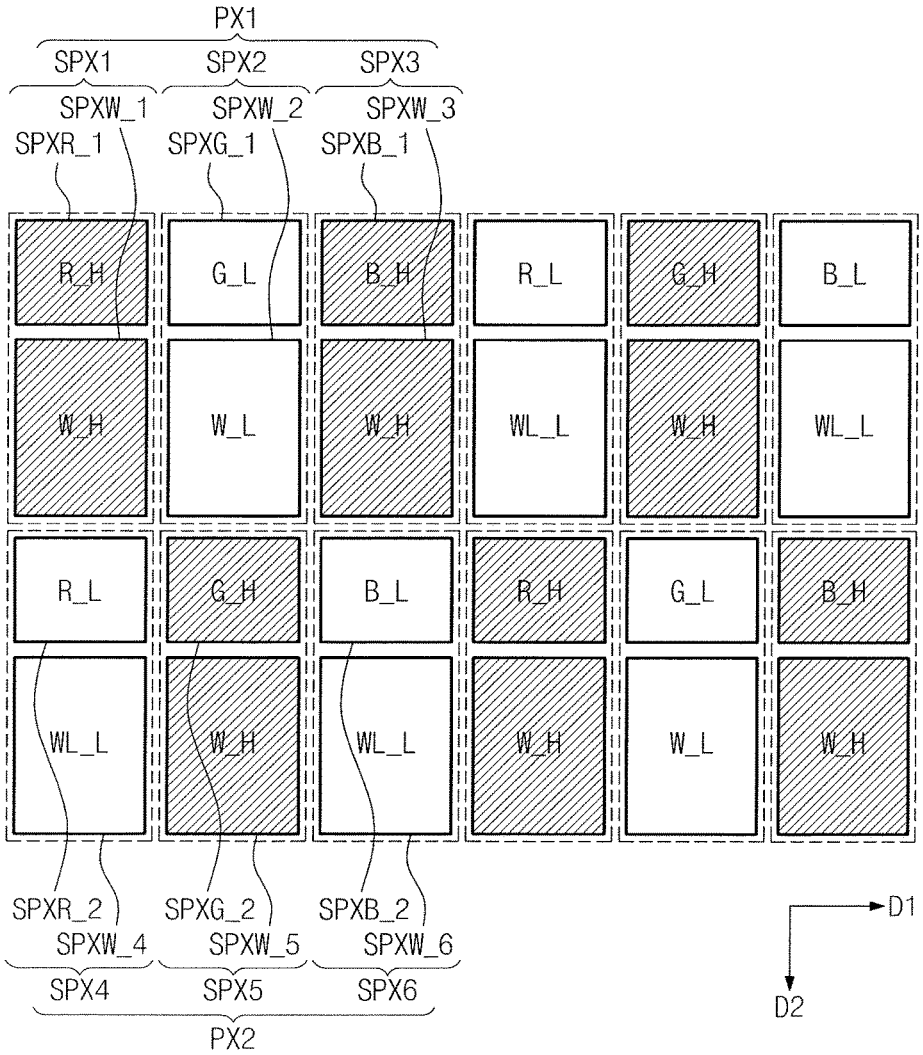
FIG. 19 illustrates another embodiment of a pixel structure.
Figure 20A:
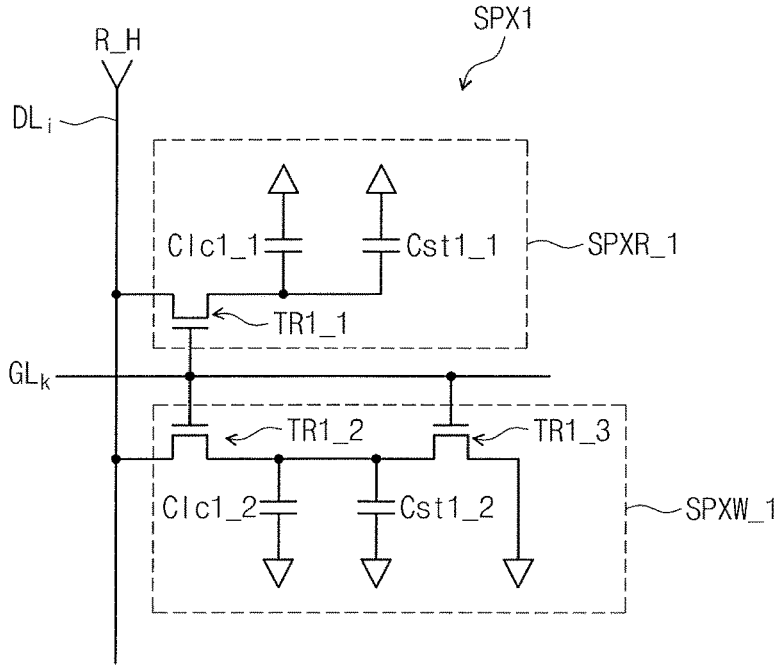
FIG. 20A illustrates an embodiment of a circuit for a first red pixel and a first white pixel in FIG. 19.
Figure 20B:
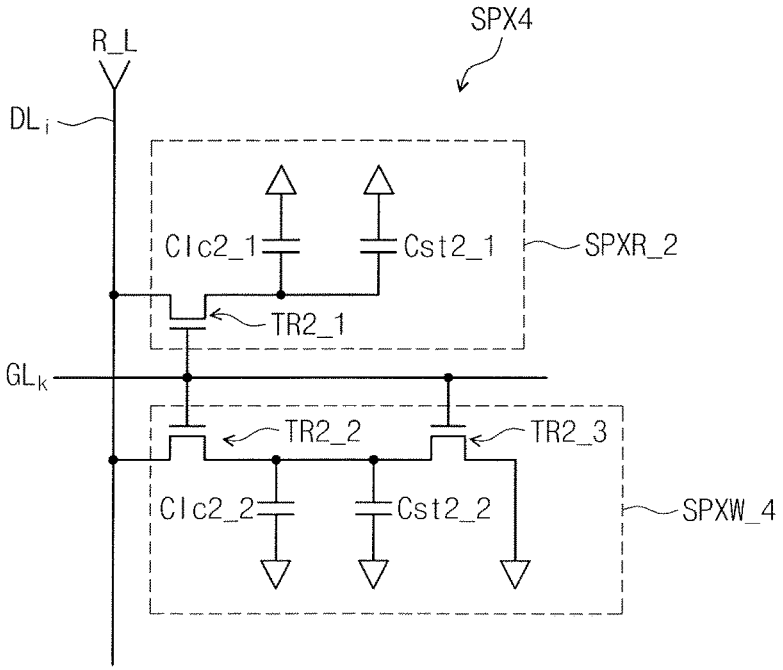
FIG. 20B illustrates an embodiment of a circuit for a second red pixel and a fourth white pixel in FIG. 19.

FIG. 19 illustrates another pixel structure of a display apparatus. FIG. 20A is an equivalent circuit illustrating an embodiment of a first red pixel and a first white pixel in FIG. 19. FIG. 20B is an equivalent circuit diagram illustrating an embodiment of a second red pixel and a fourth white pixel in FIG. 19.

Referring to FIG. 19, the display apparatus includes first and second pixel groups PX1 and PX2 alternately arranged in the first and second directions D1 and D2. The first pixel group PX1 includes first, second, and third pixels SPX1, SPX2, and SPX3, which are sequentially arranged in the first direction D1. The second pixel group PX2 includes fourth, fifth, and sixth pixels SPX4, SPX5, and SPX6, which are sequentially arranged in the first direction D1.

The first pixel SPX1 includes a first red sub-pixel SPXR_1 and a first white sub-pixel SPXW_1, the second pixel SPX2 includes a first green sub-pixel SPXG_1 and a second white sub-pixel SPXW_2, and the third pixel SPX3 includes a first blue sub-pixel SPXB_1 and a third white sub-pixel SPXW_3. The fourth pixel SPX4 includes a second red sub-pixel SPXR_2 and a fourth white sub-pixel SPXW_4, the fifth pixel SPX5 includes a second green sub-pixel SPXG_2 and a fifth white sub-pixel SPXW_5, and the sixth pixel SPX6 includes a second blue sub-pixel SPXB_2 and a sixth white sub-pixel SPXW_6.

The first, third, and fifth pixels SPX1, SPX3, and SPX5 receive red, green, and blue high voltages R_H, G_H, and B_H on the basis of the first gamma curve G1, respectively, and the second, fourth, and sixth pixels SPX2, SPX4, and SPX6 receive red, green, and blue high voltages R_L, G_L, and B_L on the basis of the second gamma curve G2, respectively.

Referring to FIGS. 19 and 20A, the first red sub-pixel SPXR_1 of the first pixel SPX1 includes a first thin film transistor TR1_1, a first liquid crystal capacitor Clc1_1, and a first storage capacitor Cst1_1. The circuit configuration of the first red sub-pixel SPXR_1 may be substantially the same as that of the first red high pixel SPX1_1H in FIG. 12A.

The first white sub-pixel SPXW_1 of the first pixel SPX1 includes a second thin film transistor TR1_2, a second liquid crystal capacitor Clc1_2, a second storage capacitor Cst1_2, and a third thin film transistor TR1_3. The circuit configuration of the first white sub-pixel SPXW_1 may be substantially the same as that of the first red low pixel SPX1_1L in FIG. 12A.

The first liquid crystal capacitor Clc1_1 of the first red sub-pixel SPXR_1 is charged with the red high voltage R_H provided through the first thin film transistor TR1_1. The red high voltage R_H provided through the second thin film transistor TR1_2 is voltage-divided by the third thin film transistor TR1_3 in the first white sub-pixel SPXW_1 of the first pixel SPX1. Accordingly, the white high voltage W_H having the gray-scale level lower than that of the red high voltage R_H is charged in the second liquid crystal capacitor Clc1_2.

Referring to FIGS. 19 and 20B, the second red sub-pixel SPXR_2 of the fourth pixel SPX4 includes a first thin film transistor TR2_1, a first liquid crystal capacitor Clc2_1, and a first storage capacitor Cst2_1. The circuit configuration of the second red sub-pixel SPXR_2 may be substantially the same as that of the second red high pixel SPX2_1H in FIG. 12B.

The fourth white sub-pixel SPXW_4 of the fourth pixel SPX4 includes a second thin film transistor TR2_2, a second liquid crystal capacitor Clc2_2, a second storage capacitor Cst2_2, and a third thin film transistor TR2_3. The circuit configuration of the fourth white sub-pixel SPXW_4 may be substantially the same as that of the second red low pixel SPX2_1L in FIG. 12B.

The first liquid crystal capacitor Clc2_1 of the second red sub-pixel SPXR_2 is charged with the red low voltage R_L provided through the first thin film transistor TR2_1. The red low voltage R_L provided through the second thin film transistor TR2_2 is voltage-divided by the third thin film transistor TR2_3 in the fourth white sub-pixel SPXW_4 of the fourth pixel SPX4. Therefore, the white low voltage W_L having the gray-scale level lower than that of the red low voltage R_L is charged in the second liquid crystal capacitor Clc2_2.

FIGS. 20A and 20B respectively show the first and fourth pixels SPX1 and SPX4 having the red color. The second and fifth pixels SPX2 and SPX5 having the green color and the third and sixth pixels SPX3 and SPX6 having the blue color may have substantially the same circuit configurations as those of the first and fourth pixels SPX1 and SPX4.

Figure 21:
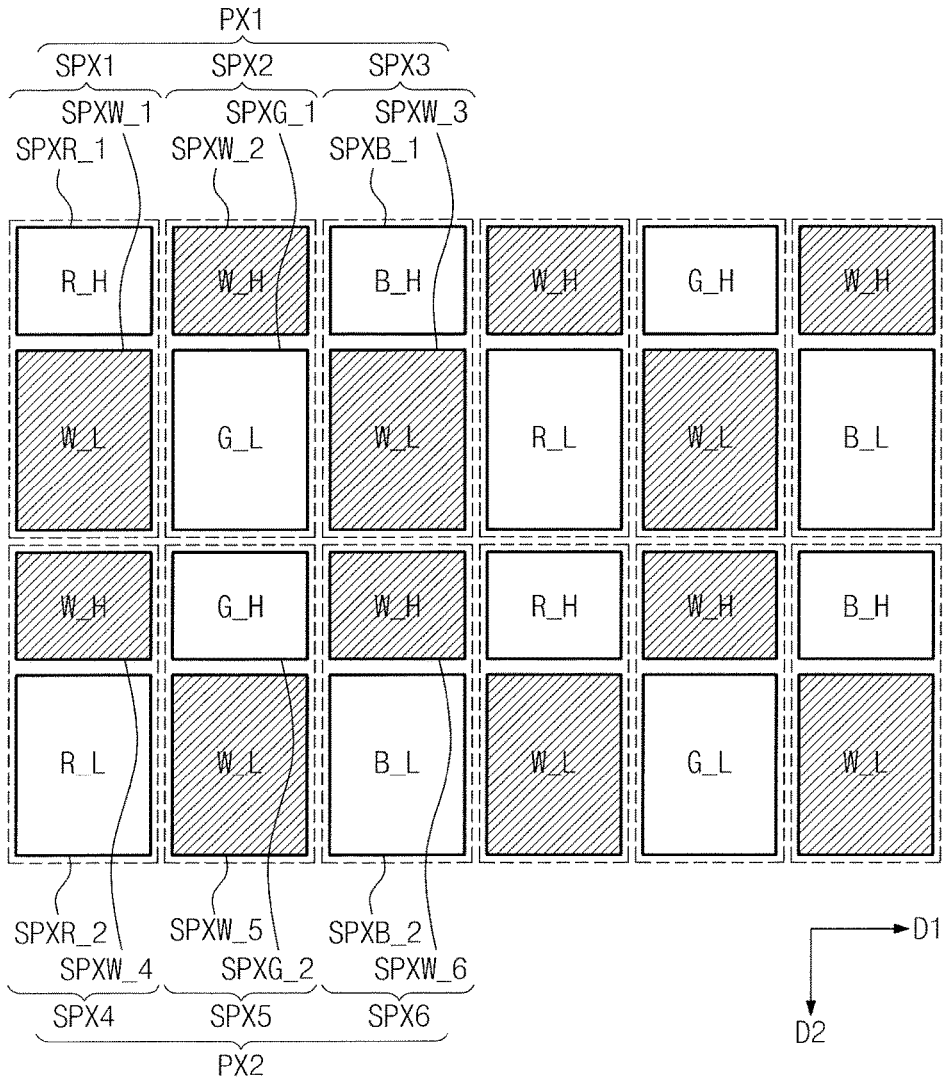
FIG. 21 illustrates another embodiment of a pixel structure.
Figure 22A:
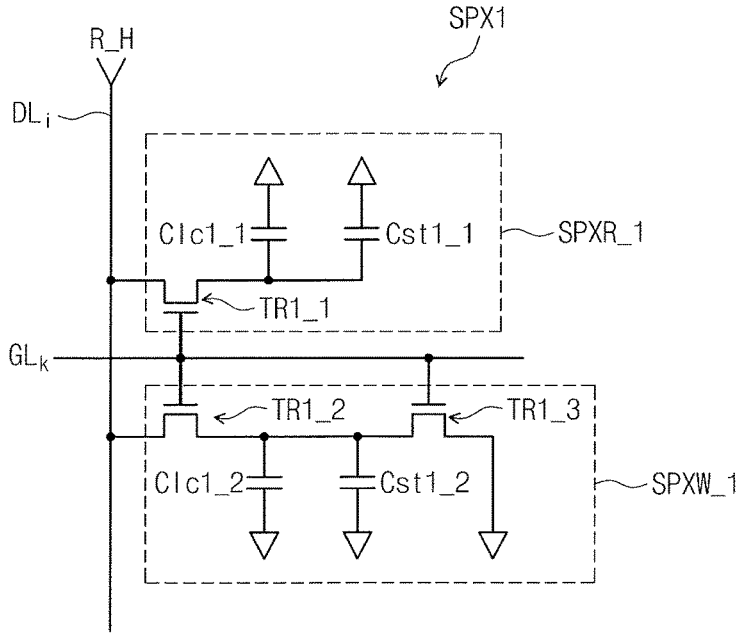
FIG. 22A illustrates an embodiment of a circuit for a first red pixel and a first white pixel in FIG. 21.
Figure 22B:
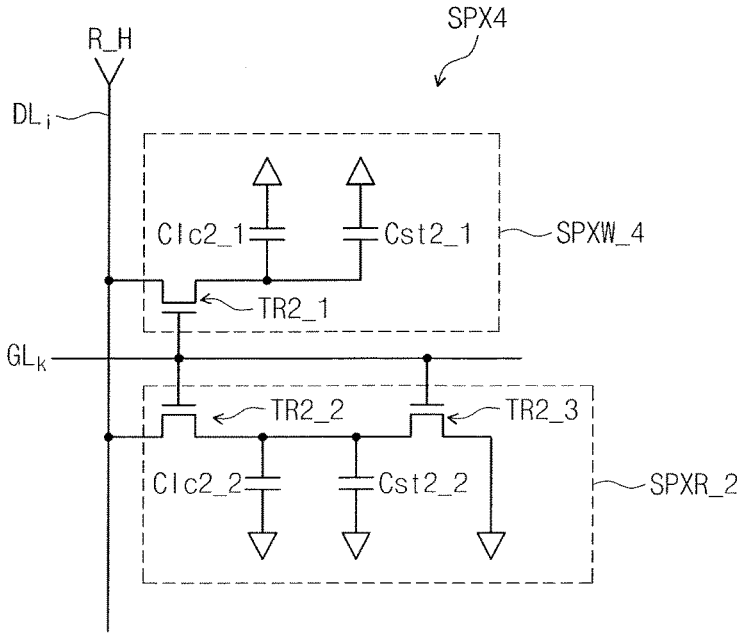
FIG. 22B illustrates an embodiment of a circuit diagram for a second red pixel and a fourth white pixel in FIG. 21.

FIG. 21 illustrates another embodiment of a pixel structure of a display apparatus. FIG. 22A is an equivalent circuit diagram illustrating an embodiment of a first red pixel and a first white pixel in FIG. 21. FIG. 22B is an equivalent circuit diagram illustrating an embodiment of a second red pixel and a fourth white pixel in FIG. 21.

Referring to FIG. 21, the display apparatus includes first and second pixel groups PX1 and PX2 alternately arranged in the first and second directions D1 and D2. The first pixel group PX1 includes first, second, and third pixels SPX1, SPX2, and SPX3, which are sequentially arranged in the first direction D1. The second pixel group PX2 includes fourth, fifth, and sixth pixels SPX4, SPX5, and SPX6, which are sequentially arranged in the first direction D1.

The first pixel SPX1 includes a first red sub-pixel SPXR_1 and a first white sub-pixel SPXW_1, the second pixel SPX2 includes a first green sub-pixel SPXG_1 and a second white sub-pixel SPXW_2. The third pixel SPX3 includes a first blue sub-pixel SPXB_1 and a third white sub-pixel SPXW_3. The fourth pixel SPX4 includes a second red sub-pixel SPXR_2 and a fourth white sub-pixel SPXW_4. The fifth pixel SPX5 includes a second green sub-pixel SPXG_2 and a fifth white sub-pixel SPXW_5. The sixth pixel SPX6 includes a second blue sub-pixel SPXB_2 and a sixth white sub-pixel SPXW_6.

Referring to FIGS. 21 and 22A, the first liquid crystal capacitor Clc1_1 of the first red sub-pixel SPXR_1 is charged with the red high voltage R_H provided through the first thin film transistor TR1_1. The red high voltage R_H provided through the second thin film transistor TR1_2 is voltage-divided by the third thin film transistor TR1_3 in the first white sub-pixel SPXW_1 of the first pixel SPX1. Accordingly, the white low voltage W_L having the gray-scale level lower than that of the red high voltage R_H is charged in the second liquid crystal capacitor Clc1_2.

Referring to FIGS. 21 and 22B, the red high voltage R_H provided through the first thin film transistor TR2_1 is charged in the first liquid crystal capacitor Clc2_1 of the fourth white sub-pixel SPXW_4 as the white high voltage W_H. The red high voltage R_H provided through the second thin film transistor TR2_2 is voltage-divided by the third thin film transistor TR2_3 in the second red sub-pixel SPXR_2 of the fourth pixel SPX4. Therefore, the red low voltage R_L having the gray-scale level lower than that of the red high voltage R_H is charged in the second liquid crystal capacitor Clc2_2.

FIGS. 22A and 22B respectively show the first and fourth pixels SPX1 and SPX4 having the red color. The second and fifth pixels SPX2 and SPX5 having the green color and the third and sixth pixels SPX3 and SPX6 having the blue color may have substantially the same circuit configurations as those of the first and fourth pixels SPX1 and SPX4.

As shown in FIGS. 21 to 22B, two pixels adjacent to each other may be operated to have different gamma characteristics in the structure the white area is disposed in each pixel even though a gamma conversion or the like is not performed on each pixel on the basis of different gamma curves.

Figure 23:
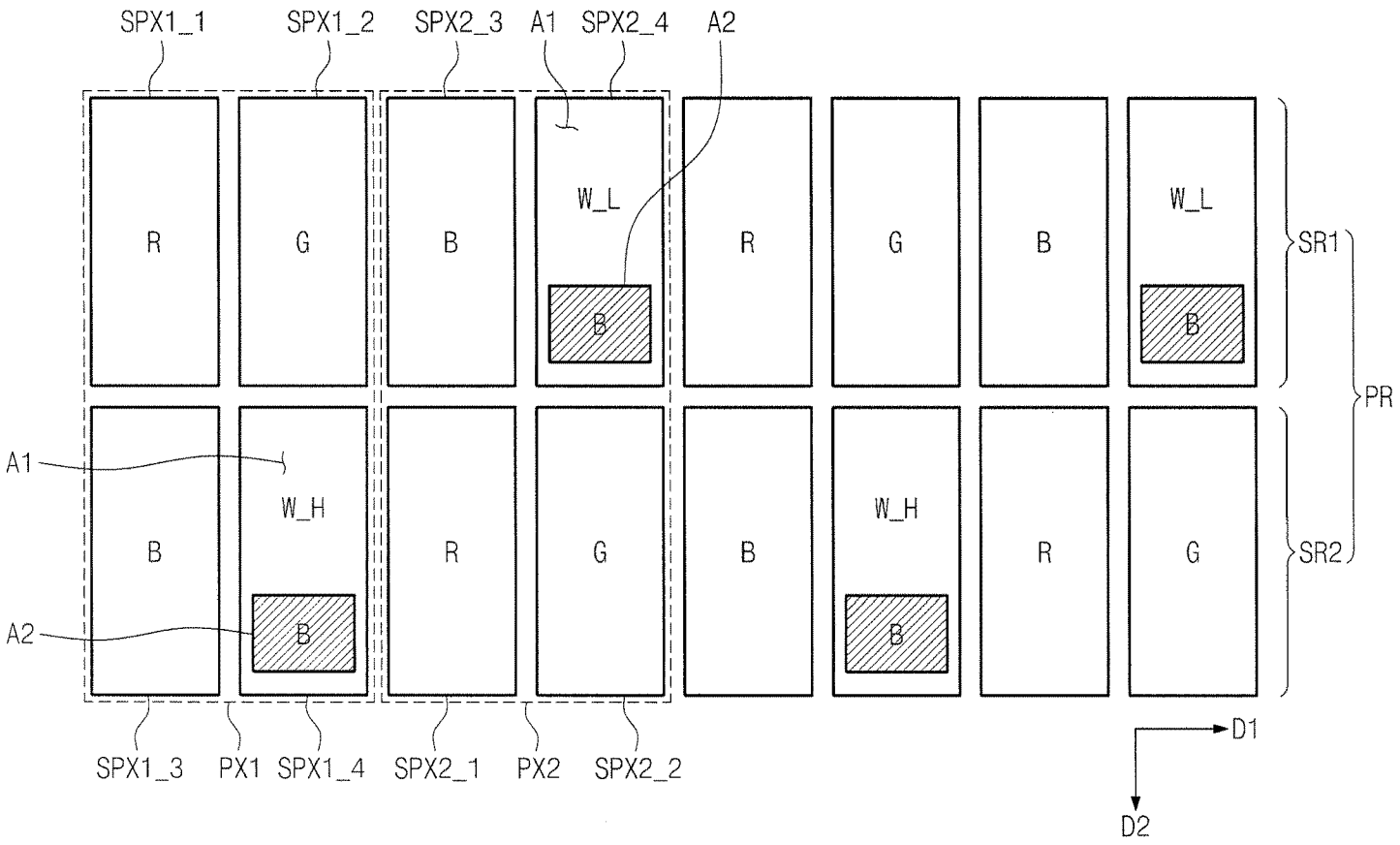
FIG. 23 illustrates another embodiment of a pixel structure.

FIG. 23 illustrates another embodiment a pixel structure of a display apparatus. Referring to FIG. 23, a first pixel group PX1 among pixel groups includes first red, first green, first blue, and first white pixels SPX1_1, SPX1_2, SPX1_3, and SPX1_4. A second pixel group PX2 among the pixel groups includes second red, second green, second blue, and second white pixels SPX2_1, SPX2_2, SPX2_3, and SPX2_4. The first pixel group PX1 and the second pixel group PX2 are adjacent to each other in at least one of the first or second directions D1 or D2. For illustrative purposes only, FIG. 23 shows the structure that the first and second pixels PX1 and PX2 are alternately arranged in the first direction D1.

The first red, first green, and first blue pixels SPX1_1, SPX1_2, and SPX1_3 include red, green, and blue color filters, respectively. The second red, second green, and second blue pixels SPX2_1, SPX2_2, and SPX2_3 include red, green, and blue color filters, respectively. Each of the first and second white pixels SPX1_4 and SPX2_4 includes a first area A1 to display the white color and a second area A2 to display the primary color. The second area A2 displays at least one color of the red, green, and blue colors. As an example, FIG. 23 shows the second area A2 in which the blue color filter is disposed, but it should not be limited thereto or thereby. For example, the red or green color filter may be disposed in the second area A2 or at least two color filters of the red, green, and blue color filters may be disposed in the second area A2.

Each pixel row PR includes first and second sub-pixel rows SR1 and SR2. The first red pixel SPX1_1 and the first green pixel SPX1_2 of the first pixel groups PX1 are arranged in the first sub-pixel row SR1. The first blue pixel SPX1_3 and the first white pixel SPX1_4 of the first pixel groups PX1 are arranged in the second sub-pixel row SR2. The second blue pixel SPX2_3 and the second white pixel SPX2_4 of the second pixel groups PX2 are arranged in the first sub-pixel row SR1. The second red pixel SPX2_1 and the second green pixel SPX2_2 of the second pixel groups PX2 are arranged in the second sub-pixel row SR2.

Accordingly, the first white pixel SPX1_4 and the second white pixel SPX2_4 are alternately arranged along the first direction D1 in each pixel row PR.

In each pixel row PR, the first white pixel SPX1_4 is applied with the white high voltage W_H generated on the basis of the first gamma curve G1 (refer to FIG. 3) and the second white pixel SPX2_4 is applied with the white low voltage W_L generated on the basis of the second gamma curve G2 (refer to FIG. 3).

Therefore, the pixels applied with the white high voltage W_H are alternately arranged with the pixels applied with the white low voltage W_L along the first direction D1 in each pixel row PR. For example, the pixels applied with the white low voltage W_L are arranged only in the first sub-pixel row SR1 of each pixel row PR and the pixels applied with the white high voltage W_H are arranged only in the second sub-pixel row SR2 of each pixel row PR.

Figure 24:
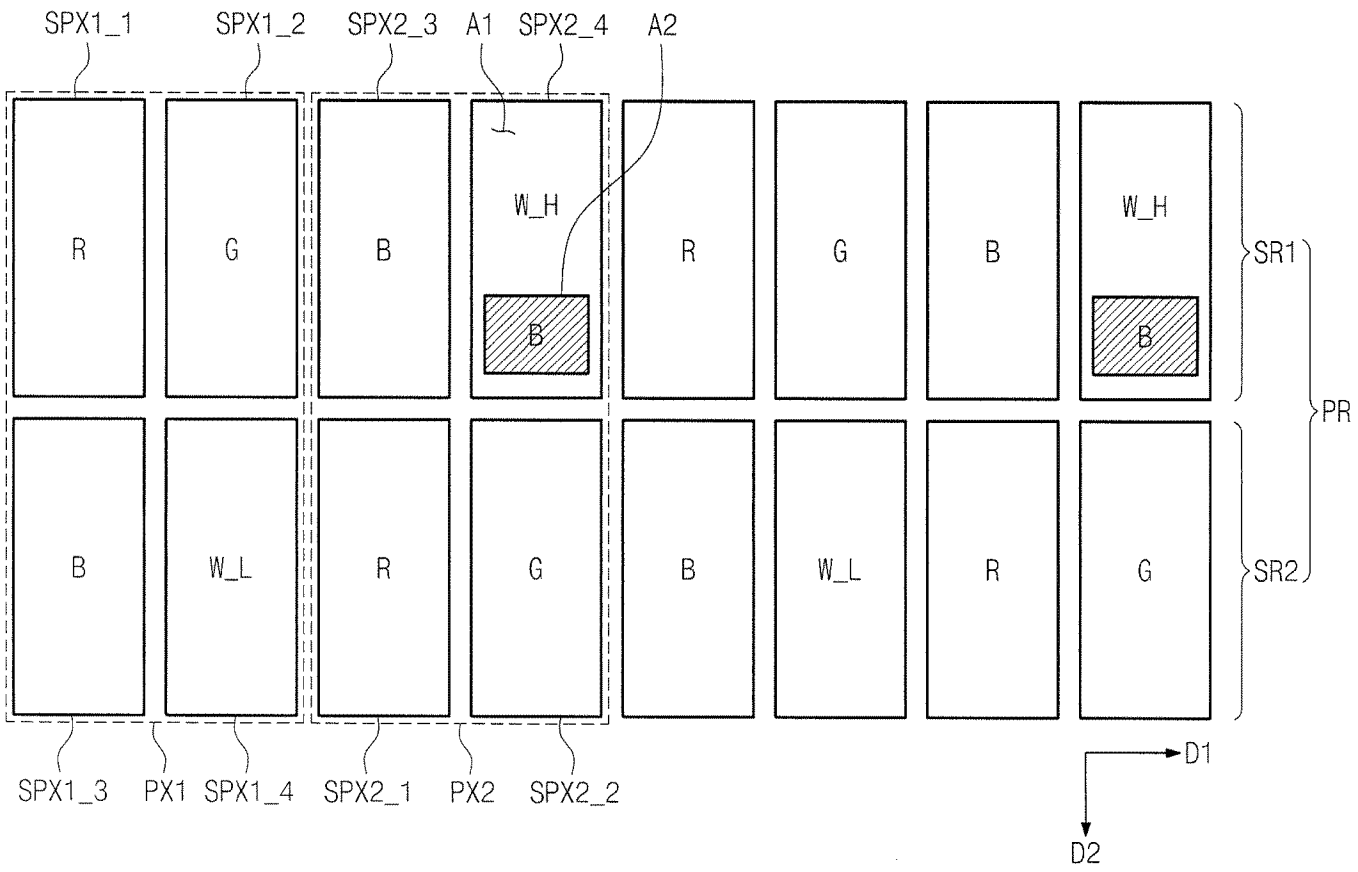
FIG. 24 illustrates another embodiment of a pixel structure.

FIG. 24 illustrates another embodiment of a pixel structure of a display apparatus. Referring to FIG. 24, a first pixel group PX1 among pixel groups includes first red, first green, first blue, and first white pixels SPX1_1, SPX1_2, SPX1_3, and SPX1_4. A second pixel group PX2 among the pixel groups includes second red, second green, second blue, and second white pixels SPX2_1, SPX2_2, SPX2_3, and SPX2_4.

The first red, first green, and first blue pixels SPX1_1, SPX1_2, and SPX1_3 respectively include red, green, and blue color filters. The second red, second green, and second blue pixels SPX2_1, SPX2_2, and SPX2_3 respectively include red, green, and blue color filters.

The second white pixel SPX2_4 includes a first area A1 to display the white color and a second area A2 to display the primary color. The second area A2 displays at least one color of the red, green, and blue colors.

The first white pixel SPX1_4 may include only the first area A1 in which the white color is displayed. The second white pixel SPX2_4 is applied with the white high voltage W_H generated on the basis of the first gamma curve G1 (refer to FIG. 3). The first white pixel SPX1_4 is applied with the white low voltage W_L generated on the basis of the second gamma curve G2 (refer to FIG. 3). For example, the white high voltage is applied to the second white pixel SPX2_4 including the second area A2 and the white low voltage is applied to the first white pixel SPX1_4 including only the first area A1.

In another example of the present disclosure, the white low voltage W_L may be applied to the second white pixel SPX2_4 including the second area A2 and the white high voltage W_H may be applied to the first white pixel SPX1_4 including only the first area A1.

In addition, the second area A2 may display at least one color of the red, green, and blue colors. For example, FIG. 24 shows the second area A2 in which the blue color filter is disposed. In another embodiment, the red or green color filter may be in the second area A2 or at least two color filters of the red, green, and blue color filters may be in the second area A2.

The controller and other processing features of the aforementioned embodiments may be implemented in logic which, for example, may include hardware, software, or both. When implemented at least partially in hardware, the controller and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controller and other processing features, may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a display device uses red, blue, and green color pixels to display color images. A liquid crystal display panel may also include a white pixel in an attempt to increase brightness of the displayed images. However, the yellowish phenomenon occurs when viewed in the side surface of the display apparatus having the white pixel.

In accordance with one or more of the aforementioned embodiments, a display apparatus includes primary color pixels and white pixels. The white pixels include a first white pixel that receives a first white pixel signal generated on the basis of a first gamma curve and a second white pixel that receives a second white pixel signal generated on the basis of a second gamma curve. The first white pixel based on the first gamma curve and the second white pixel based on the second gamma curve are therefore spatially separated from each other. Accordingly, the yellowish phenomenon may be reduced or prevented from occurring at the side surface and the whole side visibility of the display apparatus having the 4-pixel structure may be improved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display apparatus, comprising:

a plurality of primary color pixels; and a plurality of white pixels including a plurality of first white pixels to receive first white pixel signals generated based on a first gamma curve and a plurality of second white pixels to receive second white pixel signals generated based on a second gamma curve, wherein the primary color pixels and the white pixels have different arrangements in different pixel groups, wherein the first white pixels are high voltage pixels and the second white pixels are low voltage pixels, and wherein the first white pixels and second white pixels are in different columns.

2. The display apparatus as claimed in claim 1, wherein the first and second gamma curves have different brightness values with respect to a same gray-scale.

3. The display apparatus as claimed in claim 2, wherein the different pixel groups include a first pixel group to include the first white pixel and a second pixel group to include the second white pixel, and the first and second pixel groups are adjacent to each other.

4. The display apparatus as claimed in claim 3, wherein:

the primary color pixels include red, green, and blue pixels to respectively display red, green, and blue colors, and each of the first and second pixel groups further includes the red, green, and blue pixels.

5. The display apparatus as claimed in claim 4, wherein:

a first pixel of the first pixel group and a second pixel of the second pixel group display a same color among the red, green, and blue colors, one pixel of the first or second pixels receives a high signal generated based on the first gamma curve, and the other pixel of the first or second pixels receives a low signal generated based on the second gamma curve.

6. The display apparatus as claimed in claim 5, wherein:

the pixel groups are arranged in a row direction and a column direction, and the first and second pixel groups are alternately arranged with each other in each pixel row.

7. The display apparatus as claimed in claim 5, wherein:

each pixel row includes a first sub-pixel row and a second sub-pixel row, and the first and second pixels are arranged in different sub-pixel rows of the first and second sub-pixel rows.

8. The display apparatus as claimed in claim 7, wherein:

a plurality of first pixel are provided, each of the first pixels arranged in the first sub-pixel row, and a plurality of second pixels are provided and arranged in the second sub-pixel row.

9. The display apparatus as claimed in claim 8, wherein the first pixels include first positive pixels having a positive polarity and first negative pixels having a negative polarity, and the second pixels include second positive pixels having the positive polarity and second negative pixels having the negative polarity.

10. The display apparatus as claimed in claim 9, wherein:

a number of the first positive pixels is equal to a number of the first negative pixels in the first sub-pixel row, and a number of the second positive pixels is equal to a number of the second negative pixels in the second sub-pixel row.

11. The display apparatus as claimed in claim 7, further comprising:

a plurality of gate lines extending in the row direction; and a plurality of data lines extending in the column direction, wherein the pixels of the first sub-pixel row are connected to a k-th gate line among the gate lines and the pixels of the second sub-pixel row are connected to a (k+1)th gate line among the gate lines.

12. The display apparatus as claimed in claim 11, wherein the pixels in a j-th column disposed between an i-th data line and an (i+1)th data line among the data lines are arranged in the column direction, and the pixels in the j-th column are connected to one of the i-th data line and the (i+1)th data line.

13. The display apparatus as claimed in claim 12, wherein, among the pixels arranged in the j-th column, the pixels arranged in the first sub-pixel row are connected to the i-th data line and the pixels arranged in the second sub-pixel row are connected to the (i+1)th data line.

14. The display apparatus as claimed in claim 11, wherein all the pixels in the j-th column are connected to the i-th data line.

15. The display apparatus as claimed in claim 11, wherein a polarity of the pixel signal applied to the data lines is inverted every four data lines.

16. The display apparatus as claimed in claim 4, wherein:

at least one pixel of the red, green, or blue pixels of the first pixel group has a gamma characteristic corresponding to the first gamma curve, other pixels of the red, green, or blue pixels of the first pixel group have a gamma characteristic corresponding to the second gamma curve, at least one pixel of the red, green, or blue pixels of the second pixel group has the gamma characteristic corresponding to the second gamma curve, and other pixels of the red, green, or blue pixels of the second pixel group have the gamma characteristic corresponding to the first gamma curve.

17. The display apparatus as claimed in claim 16, wherein the first and second gamma curves have different brightness values from each other with respect to the same gray-scale.

18. The display apparatus as claimed in claim 4, wherein each of the primary color pixels and each of the white pixels are divided into a high gray-scale area and a low gray-scale area.

19. The display apparatus as claimed in claim 18, wherein:

the high gray-scale area has the gamma characteristic corresponding to the first gamma curve and the low gray-scale area has the gamma characteristic corresponding to a third gamma curve having a brightness value lower than the first gamma curve with respect to the same gray-scale in the pixel applied with the pixel signal based on the first gamma curve among the primary color pixels and the white pixels, and the high gray-scale area has the gamma characteristic corresponding to the second gamma curve and the low gray-scale area has the gamma characteristic corresponding to a fourth gamma curve having a brightness value lower than the second gamma curve with respect to the same gray-scale in the pixel applied with the pixel signal based on the second gamma curve among the primary color pixels and the white pixels.

20. The display apparatus as claimed in claim 4, wherein the first and second pixel groups are alternately arranged in a row direction and a column direction and disposed adjacent to each other.

21. The display apparatus as claimed in claim 20, wherein:

a first pixel of the first pixel group and a second pixel of the second pixel group display a same color of the red, green, or blue colors, one pixel of the first or second pixels receives a high signal generated based on the first gamma curve, and the other pixel of the first or second pixels receives a low signal generated on the basis of the second gamma curve.

22. The display apparatus as claimed in claim 21, wherein the first and second pixels are alternately arranged in the unit of pixel along the same pixel row and the same pixel column.

23. A display apparatus, comprising:

a timing controller to receive an input image data, convert the input image data to a primary color data and a white data, and convert the white data to first and second white pixel data on the basis of first and second gamma curves;

a driver to convert the first and second white pixel data to first and second white pixel voltages; and a display panel including primary color pixels and white pixels, the white pixels including a plurality of first white pixels applied with the first white pixel voltage and a second white pixel applied with the second white pixel voltage, the first white pixel voltage being a high white pixel voltage and the second white pixel voltage being a low white pixel voltage, wherein the primary color pixels and the white pixels have different arrangements in different pixel groups, and wherein the first white pixels and second white pixels are in different columns.

24. The display apparatus as claimed in claim 23, further comprising:

a first look-up table to store a first sampling data sampled from the first gamma curve; and a second look-up table to store a second sampling data sampled from the second gamma curve.

25. The display apparatus as claimed in claim 24, wherein:

the primary color data includes red, green, and blue color data, and the timing controller is to convert each of the red, green, and blue color data to a high pixel data and a low pixel data with reference to the first and second look-up tables.

26. The display apparatus as claimed in claim 23, wherein:

the first gamma curve has a brightness value higher than a reference gamma curve with respect to a same gray-scale, and the second gamma curve has a brightness value lower than the reference gamma curve with respect to the same gray-scale.

27. The display apparatus as claimed in claim 26, wherein:

the first gamma curve includes first and second sub-gamma curves having different brightness values with respect to the same gray-scale, the second gamma curve includes third and fourth sub-gamma curves having different brightness values with respect to the same gray-scale, the primary color data is converted to a first primary pixel data based on the first sub-gamma curve, the white color data is converted to the first white pixel data based on the second sub-gamma curve, the primary color data is converted to a second primary pixel data based on the third sub-gamma curve, and the white color data is converted to the second white pixel data based on the fourth sub-gamma curve.

28. The display apparatus as claimed in claim 23, wherein:

the primary color pixels and the white pixels form pixel groups, the pixel groups include a first pixel group and a second pixel group, the first pixel group includes the first white pixel, the second pixel group includes the second white pixel, and the first and second pixel groups are adjacent to each other.

* * * * *